US005478693A

United States Patent [19]

Hirai

[11] Patent Number: 5,478,693

[45] Date of Patent: Dec. 26, 1995

[54] DIFFUSION TRANSFER HEAT-DEVELOPABLE COLOR PHOTOGRAPHIC LIGHT-SENSITIVE MATERIAL AND PROCESS FOR FORMING COLOR IMAGE

[75] Inventor: Hiroyuki Hirai, Kanagawa, Japan

[73] Assignee: Fuji Photo Film Co., Ltd., Kanagawa, Japan

[21] Appl. No.: 250,447

[22] Filed: May 27, 1994

[30] Foreign Application Priority Data

May 31, 1993 [JP] Japan ..... 5-149713

[51] Int. Cl.[6] ..... G03C 8/52; G03C 8/40; G03C 1/83

[52] U.S. Cl. ..... 430/203; 430/220; 430/507; 430/517; 430/519; 430/521

[58] Field of Search ..... 430/203, 220, 430/519, 507, 517, 521

[56] References Cited

U.S. PATENT DOCUMENTS

| | | | |
|---|---|---|---|
| 4,514,493 | 4/1985 | Hirai et al. | 430/203 |
| 4,542,092 | 9/1985 | Toya et al. | 430/220 |
| 4,728,595 | 3/1988 | Hayashi et al. | 430/220 |
| 4,740,445 | 4/1988 | Hirai et al. | 430/203 |
| 5,071,740 | 12/1991 | Okauchi et al. | 430/220 |
| 5,098,820 | 3/1992 | McManus et al. | 430/507 |
| 5,270,155 | 12/1993 | Ozaki et al. | 430/220 |

FOREIGN PATENT DOCUMENTS

| | | |
|---|---|---|
| 190512B | 9/1982 | European Pat. Off. . |
| 157639A | 9/1986 | European Pat. Off. . |
| 59-174830 | 10/1984 | Japan . |
| 60-209734 | 10/1985 | Japan . |
| 61-20943 | 1/1986 | Japan . |
| 61-159645 | 7/1986 | Japan . |
| 1167838 | 7/1989 | Japan . |
| 2271353 | 2/1990 | Japan . |

*Primary Examiner*—Richard L. Schilling
*Attorney, Agent, or Firm*—Sughrue, Mion, Zinn, Macpeak & Seas

[57] ABSTRACT

The present invention provides a diffusion transfer heat-developable color photographic light-sensitive material comprising a support having thereon at least one light-sensitive silver halide emulsion layer and a nondiffusing dye-providing compound which releases or forms a diffusive dye in response to or in counter response to a reaction by which a silver halide is reduced to silver under the presence of a reducing agent, and an organic solid pigment in at least one of light-sensitive silver halide emulsion layer and the layer(s) adjacent thereto, and a method for forming a color image using the light-sensitive material.

11 Claims, No Drawings

DIFFUSION TRANSFER HEAT-DEVELOPABLE COLOR PHOTOGRAPHIC LIGHT-SENSITIVE MATERIAL AND PROCESS FOR FORMING COLOR IMAGE

FIELD OF THE INVENTION

The present invention relates to a diffusion transfer heat-developable color photographic light-sensitive material and a process for the formation of a color image on such a heat-developable color photographic light-sensitive material and more particularly to a diffusion transfer heat-developable color photographic light-sensitive material having an improved color reproducibility and a process for the formation of a color image on such a heat-developable color photographic light-sensitive material.

BACKGROUND OF THE INVENTION

A diffusion transfer heat-developable photographic light-sensitive material is known in this field. For the heat-developable photographic light-sensitive material and its processing method, reference can be made, for example, to *Shashin Kogaku no Kiso* (*Base of Photographic Engineering*), Edition of Nonsilver Photography, pp. 242–255; Corona, 1982.

Also, many methods for obtaining a color image by heat development have been proposed. For example, U.S. Pat. Nos. 3,531,286, 3,761,270 and 4,021,240, Belgian Pat. 802,519, Research Disclosure (hereinafter abbreviated as "RD"), September 1975, pp. 31–32, etc. propose a method for forming a color image by the combination of an oxidized product of a developing agent and a coupler.

However, since the foregoing heat-developable photographic light-sensitive material on which a color image is formed is of nonfixable type, silver halide remains even after the formation of an image, causing a serious problem of coloring on the white ground when exposed to strong light or after prolonged storage. Further, the foregoing methods are disadvantageous in that they normally require a relatively long period of time for development and the resulting image exhibits a significant fog and a low density.

In order to overcome these difficulties, an approach has been proposed which comprises imagewise forming or releasing a diffusive dye by heating, and then transferring the diffusive dye to an image-receiving material having a mordant with a solvent such as water (see U.S. Pat. Nos. 4,500,626, 4,483,914, 4,503,137, and 4,559,920, and JP-A-59-165054 (The term "JP-A" as used herein means an "unexamined published Japanese patent application")).

In the foregoing approach, a high development temperature is still required, and the preservability of the photographic light-sensitive material is still insufficient. Accordingly, an approach is disclosed which comprises heat development of a photographic light-sensitive material in the presence of a base or base precursor and a slight amount of water, and then transferring the resulting dye to provide acceleration of development, lowering of development temperature and simplification of processing in JP-A-59-218443, JP-A-61-238056, and JP-A-62-129848, and European Patent 210660A2.

Many methods for obtaining a positive color image by heat development have been proposed. Among these methods is an approach proposed in U.S. Pat. No. 4,559,290 which comprises heat development of a photographic light-sensitive material in the presence of an oxidizing type DRR compound having no capability of releasing a dye and a reducing agent or precursor thereof so that the reducing agent is oxidized depending on the exposure of silver halide and the oxidizing type DDR compound is then reduced by the reducing agent left unoxidized to release a diffusive dye. Further, U.S. Pat. No. 4,783,396 and JP-A-64-13546 disclose a heat-developable color photographic light-sensitive material comprising a nondiffusion compound which undergoes reductive cleavage of N-X bond (wherein X represents an oxygen atom, nitrogen atom or sulfur atom) to release a diffusive dye as a nondiffusion compound which releases a diffusive dye by the same mechanism as mentioned above. This process comprises exposing a multi-layer heat-developable color photographic light-sensitive material having at least a light-sensitive silver halide, a binder, an electron donor and/or precursor thereof (preferably nondiffusive), and a compound which is nondiffusive itself but undergoes reduction to release a diffusive dye on a support to light, and then heating the heat-developable color photographic light-sensitive material so that the electron donor is oxidized depending on the amount of the silver halide and the reducible dye-providing compound is reduced by the electron donor left unoxidized to release a diffusive dye which is then transferred to a dye-fixing (image-receiving) material comprising a mordant to form a positive color image.

An ordinary silver halide color photographic material has a multi-layer configuration. An example of such a multi-layer configuration comprises a panchromatic silver halide emulsion layer sensitive to red light, an orthochromatic silver halide emulsion layer sensitive to green light, and a regular silver halide emulsion layer sensitive to blue light as an uppermost layer coated sequentially on a support.

The foregoing color photographic light-sensitive material comprises panchromatic and orthochromatic silver halide emulsions which have been spectrally sensitized with an optical sensitizer generally referred to as "sensitizing dye". However, these emulsions also have blue-sensitivity characteristic of silver halide, causing color turbidity or color loss due to overlapping of spectrum and hence impairing color reproducibility.

In order to cope with the foregoing difficulty, a color negative photographic light-sensitive material normally comprises a blue light-absorbing filter layer provided interposed between a blue-sensitive silver halide emulsion layer and a green-sensitive silver halide emulsion layer. As such a blue light-absorbing filter layer, a layer comprising a silver colloid having a grain diameter of about 0.001 to 0.05 μm or a layer comprising a dye or dyestuff which elutes with a processing solution or discolors during development as disclosed in U.S. Pat. Nos. 4,948,717, 4,948,718, 4,940,645, and 4,900,653 is used.

In a heat-developable color photographic light-sensitive material comprising a dye-providing compound which is colored, the layer containing such a dye-providing compound serves as a filter layer itself. Accordingly, such a heat-developable color photographic light-sensitive material does not necessarily require another blue light-absorbing filter layer. However, if the dye-providing compound is a colorless coupler or if the absorptivity coefficient of the heat-developable color photographic light-sensitive material at 500 nm or less is insufficient, it is preferable that a blue light-absorbing filter layer be provided.

Nevertheless, the heat-developable photographic light-sensitive material cannot comprise a silver colloid layer as mentioned above. This is because the heat-developable photographic light-sensitive material encounters a phenomenon in which colloidal silver serves as a physical development nucleus, resulting in aggravation of fogging, density drop or color turbidity.

Further, it is undesirable to use a dye or dyestuff which elutes with a processing solution or discolors during development in the heat-developable photographic light-sensitive material. That is, since the heat-developable photographic light-sensitive material is developed in a short period of time, such a dye or dyestuff cannot be sufficiently discolored or is transferred to the image-receiving material causing color stain.

JP-A-60-209734, JP-A-61-159645, and JP-A-2-271353 disclose a blue lights absorbing dye for use in a heat-developable photographic light-sensitive material. However, this blue light-absorbing dye is insufficient in the requirements that it should be prevented from being diffused into other layers during simultaneous multi-layer coating or storage and should not stain the image during heat development or heat transfer.

On the other hand, the incorporation of a colored solid pigment such as cadmium yellow in the silver halide emulsion layer and/or its adjacent layers in a heat-developable color photographic light-sensitive material is disclosed in JP-A-61-20943, and JP-A-1-167838. However, the object of this approach is to enhance sensitivity and to improve S/N ratio and the preservability of a raw photographic light-sensitive material. Accordingly, this approach does not necessarily provide a satisfactory blue light-absorbing filter. Further, in a color image formation process which comprises imagewise exposing a heat-developable color photographic light-sensitive material to light, subjecting the heat-developable color photographic light-sensitive material to heat development in the presence of a small amount of water and a base precursor, and then transferring a diffusive dye thus produced or released to an image-receiving material, if the base precursor is a combination of a scarcely water-soluble basic metal compound and a compound capable of undergoing a complex compound formation reaction with metal ions constituting said basic metal compound in the presence of water as a medium (complexing agent), an inorganic solid pigment, if used, reacts with the complexing agent to produce a water-soluble colored material which is then transferred to the image-receiving material to cause color stain or produce a substance that adversely affects the photographic properties.

SUMMARY OF THE INVENTION

It is therefore an object of the present invention to provide a diffusion transfer heat-developable color photographic light-sensitive material which is insusceptible to color turbidity and color loss to exhibit an improved color reproducibility.

It is another object of the present invention to provide a diffusion transfer heat-developable color photographic light-sensitive material which is less susceptible to fogging and color stain and exhibits a high contrast.

It is a further object of the present invention to provide a diffusion transfer heat-developable color light-sensitive material which exhibits an excellent preservability before use.

It is a still further object of the present invention to provide a color image formation process which gives an improved color reproducibility.

These and other objects of the present invention will become more apparent from the following detailed description and examples.

The foregoing and other objects of the present invention are accomplished with a diffusion transfer heat-developable color photographic light-sensitive material comprising a support having thereon at least one light-sensitive silver halide emulsion layer, a nondiffusing dye-providing compound which releases or forms a diffusive dye in response to or in counter response to a reaction by which a silver halide is reduced to silver in the presence of a reducing agent, and an organic solid pigment in at least one of the at least one light-sensitive silver halide emulsion layer and the layer(s) adjacent thereto.

The objects of the present invention are also accomplished by a process for the formation of a color image which comprises subjecting the heat-developable color photographic light-sensitive material as defined above to imagewise exposure to light, heat-developing said color photographic light-sensitive material in the presence of a reducing agent, and transferring a diffusive dye thus released or formed to an image-receiving material.

DETAILED DESCRIPTION OF THE INVENTION

The organic solid pigment employed in the present invention is substantially insoluble in water (or has a solubility of not more than 0.1 g/100 g in water at 20° C). Examples of such an organic solid pigment include azo pigment, condensed polycyclic pigment (such as an isoindolinone, an anthraquinone, a flavanthrone, an anthrapyrimidine, an anthraquinone, a quinophthalone and a copper complex salt of an azomethyne), etc. These organic solid pigments are described in *Color Index* (*C. I.*) *Binran* (*Handbook of Color Index* (*C. I.*), Nihon Ganryo Gijutu Kyokai, *Saishin Ganryo Binran* (*Handbook of Modern Pigments*), Nihon Ganryo Gijutu Kyokai, 1977, *Saishin Ganryo Oyo Gijutu* (*Applied Technique of Modern Pigments*), CMC Shuppan, 1986, *Insatsu Ink Gijutu (Techinique of Printing Ink*), CMC Shuppan, 1984, *Shikizai Kogaku Handbook* (*Handbook of Color Material Engineering*), Shadan Hojin Shikizai Kyokai, Asakura Shoten, 1989, etc. Many of these organic solid pigments are commercially available.

An organic solid pigment which can be preferably used in the present invention is represented by the following general formula (I):

Cyan dye-providing compound (A1)
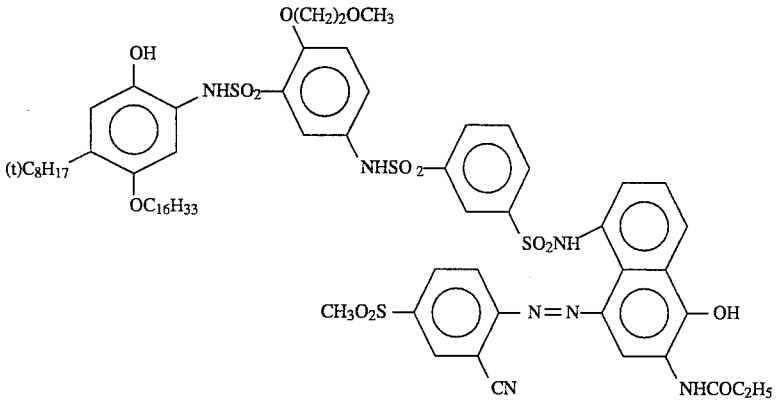
Cyan dye-providing compound (A2)
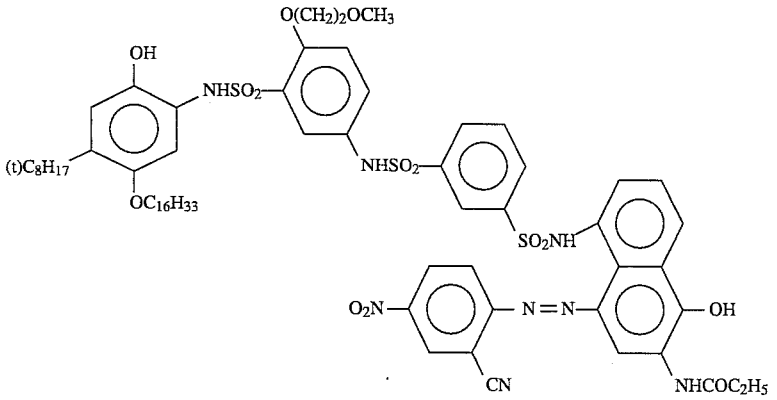
Fog inhibitor (3)
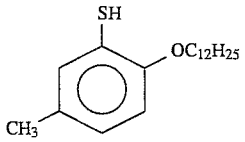
High boiling solvent (1)
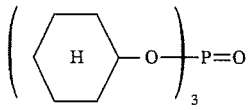
High boiling solvent (2)
$(C_8H_{17}O)_3-P=O$
Surface active agent (1)
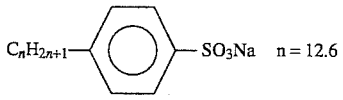
65
wherein $R_1$ to $R_{10}$ each represents a hydrogen atom or a substituent such as a halogen atom (e.g., chlorine, fluorine, bromine), an alkyl group (e.g., methyl, ethyl), an alkoxy group (e.g., methoxy, ethoxy), a nitro group, an acyl group (such as an aliphatic acyl group and aromatic acyl group, e.g., acetyl, propionyl, benzoyl), an aryl group (e.g., phenyl), an aryloxy group (e.g., phenoxy), a sulfamoyl group, an alkylsulfamoyl group (e.g., methylsulfamoyl, ethylsulfamoyl), an arylsulfamoyl group (e.g., phenylsulfamoyl), an alkoxycarbonyl group (e.g., methoxycarbonyl, ethoxycarbonyl), an aryloxycarbonyl group (e.g., phenoxycarbonyl), a carbamoyl group, an alkylcarbamoyl group (e.g., methylcarbamoyl, ethylcarbamoyl), an arylcarbamoyl group (e.g., phenylcarbamoyl), an acylamino group (such as an aliphatic acylamino group and an aromatic acylamino group, e.g., acetylamino, benzoylamino), an alkylsulfonylamino group (e.g., methylsulfonylamino), an arylsulfonylamino group (e.g., phenylsulfonylamino), a ureido group, and a group represented by general formula (I-a);

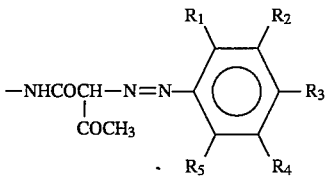

(I-a)

wherein $R_1$ to $R_5$ are as defined in the general formula (I) (each of them may represent the same as or different from $R_1$ to $R_5$ in formula (I)) with the proviso that $R_1$ and $R_2$, $R_2$ and $R_3$, $R_3$ and $R_4$, $R_4$ and $R_5$, $R_6$ and $R_7$, $R_7$ and $R_8$, $R_8$ and $R_9$, or $R_9$ and $R_{10}$ on the same benzene ring may together form a heterocyclic ring (such as a 5- to 7- membered heterocyclic ring containing at least one of N, O and S atoms or containing further

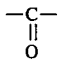

group in the heterocyclic ring, e.g., imidazolone ring, imido ring); or the organic solid pigment may be a bis compound (preferably symmetrical; containing also a dimer) formed by connecting two molecules represented by general formula (I) via the respective $R_3$ or $R_8$, or via a single bond at the position of $R_3$ or $R_8$ on the benzene ring (in this case $R_3$ and $R_8$ each represents a single bond). The substituents represented by $R_1$ to $R_{10}$ may further have at least one of substituents such as those recited above as examples of $R_1$ to $R_{10}$ (examples of such substituted substituents include 2-methyl-4-chloro-phenylsulfamoyl, 2 -methyl-3-chloro-phenylcarbamoyl, and trifluoromethyl).

The number of carbon atoms of the organic substituents represented by $R_1$ to $R_{40}$ is preferably within the range of from 1 to 40 (including carbon atoms of substituents which are further substituted).

The organic pigment employed in the present invention is preferably substantially insoluble also in a high boiling organic solvent such as phosphoric ester and phthalic ester and a low boiling organic solvent such as ethyl acetate, methyl ethyl ketone, cyclohexanone and methanol and preferably does not contain any ballast group such as an alkyl group containing not less than 8 carbon atoms and an aryl group having an alkyl group containing not less than 4 carbon atoms as a substituent.

From the foregoing standpoint of view, a symmetrical compound is particularly preferred.

The organic pigment employed in the present invention preferably has a maximum absorption spectrum of 500 nm or less, particularly between 360 nm and 500 nm (preferably as an yellow filter).

Specific examples of organic solid pigments employed in the present invention are given below, but the present invention should not be construed as being limited thereto. Compounds (1) to (31) are examples of pigments represented by the general formula (I).

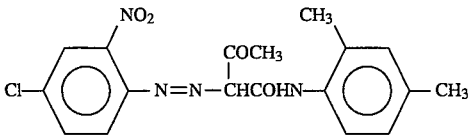

Pigment (1)

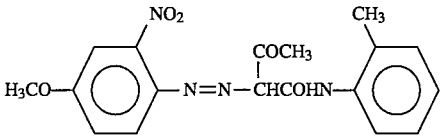

Pigment (2)

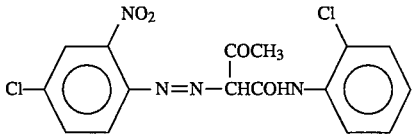

Pigment (3)

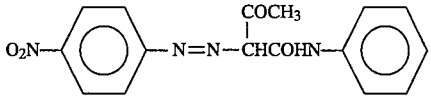

Pigment (4)

-continued
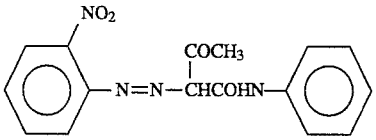
Pigment (5)
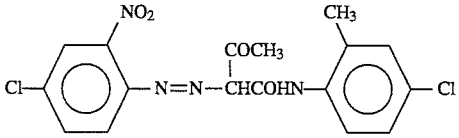
Pigment (6)
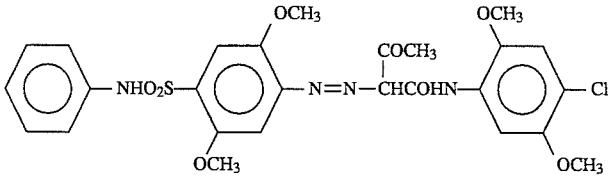
Pigment (7)
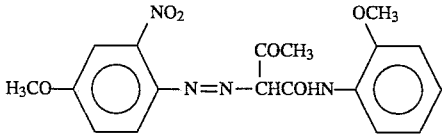
Pigment (8)
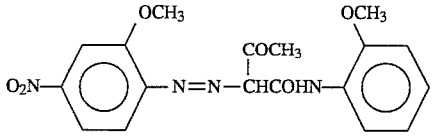
Pigment (9)
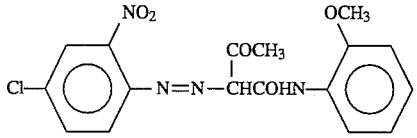
Pigment (10)
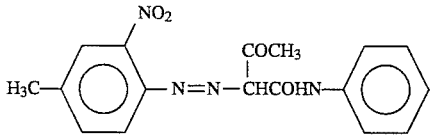
Pigment (11)
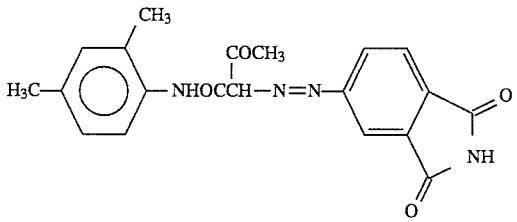
Pigment (12)
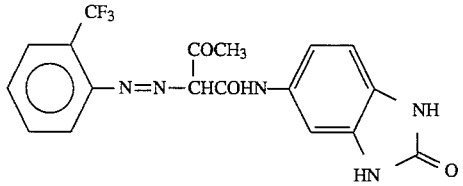
Pigment (13)

-continued
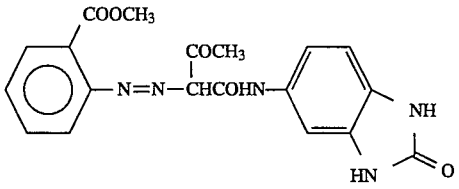
Pigment (14)
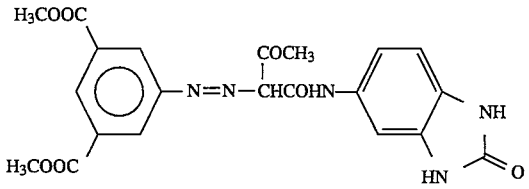
Pigment (15)
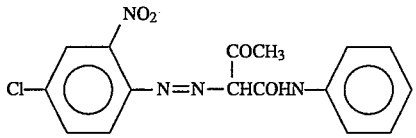
Pigment (16)
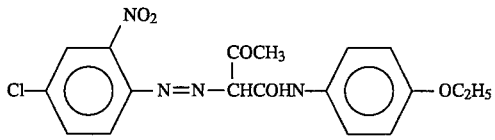
Pigment (17)
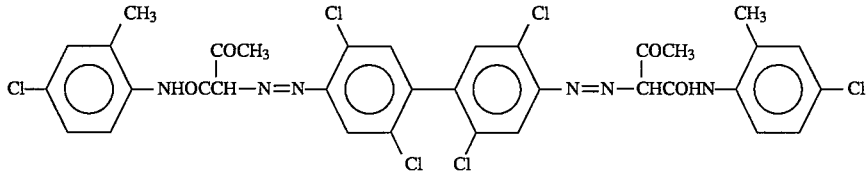
Pigment (18)
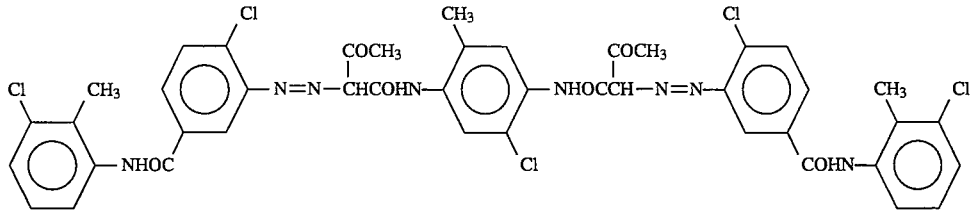
Pigment (19)
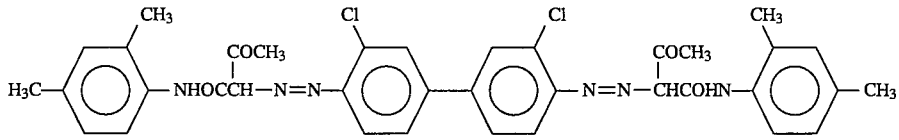
Pigment (20)
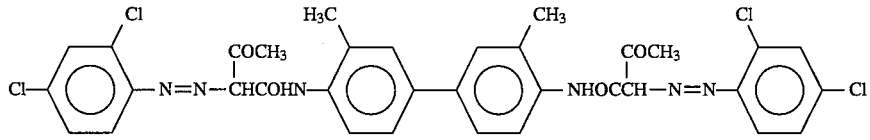
Pigment (21)
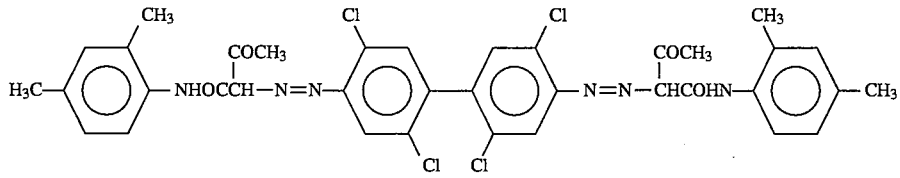
Pigment (22)

-continued
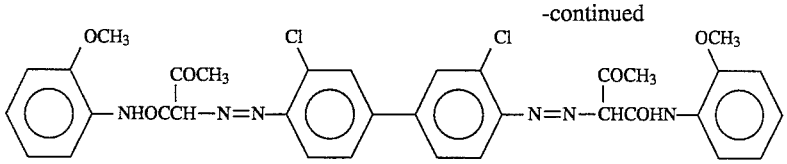
Pigment (23)
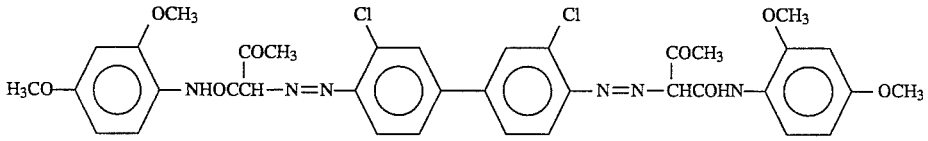
Pigment (24)
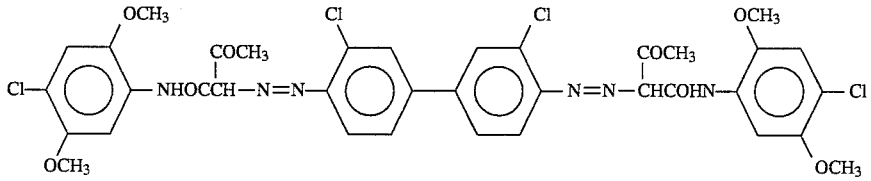
Pigment (25)
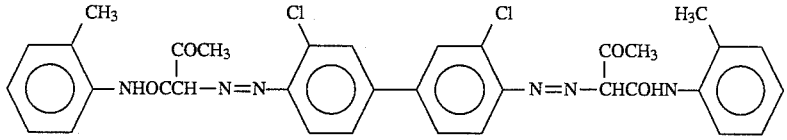
Pigment (26)
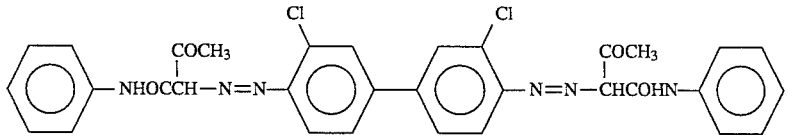
Pigment (27)
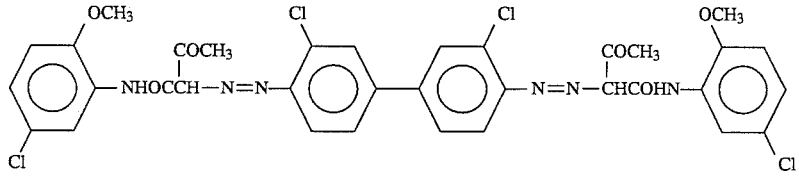
Pigment (28)
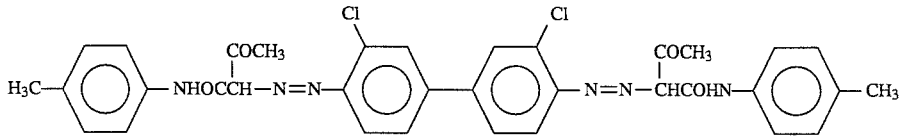
Pigment (29)
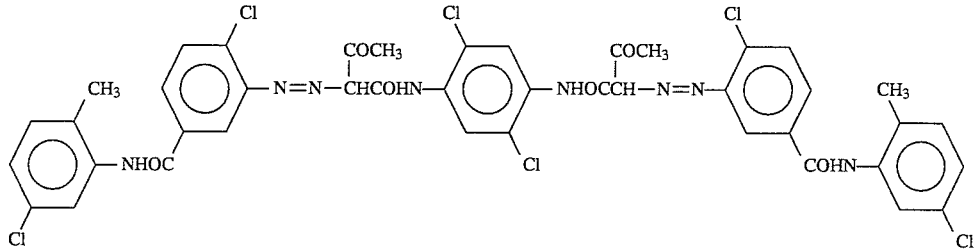
Pigment (30)
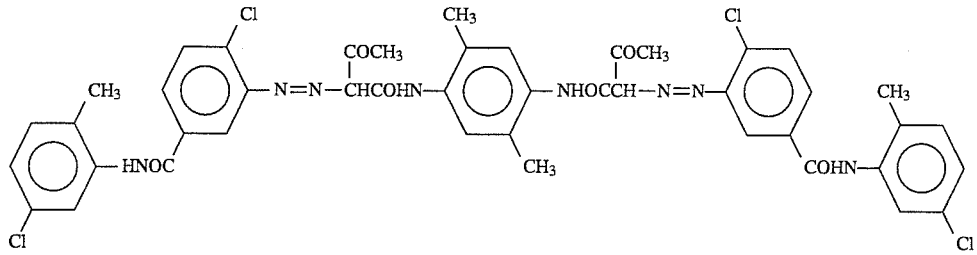
Pigment (31)

-continued
(Isoindolinone pigment)
Pigment (32)
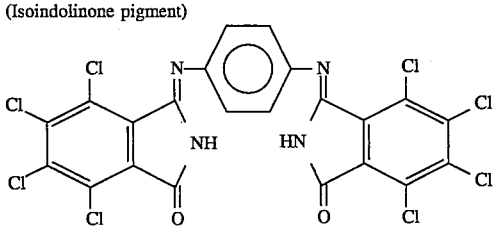
(Authraquinone pigment)
Pigment (33)
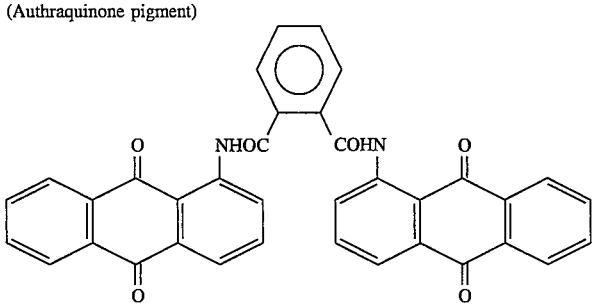
(Isoindolinone pigment)
Pigment (34)
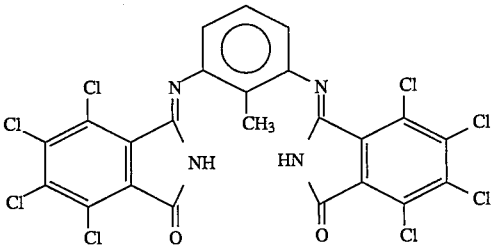
(Flavanthrone pigment)
Pigment (35)
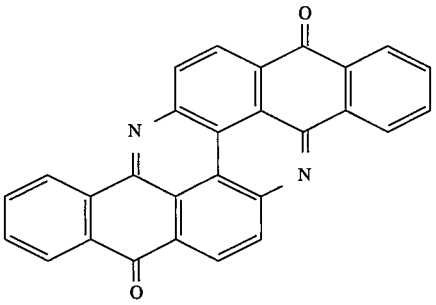
(Anthrapyrimidine pigment)
Pigment (36)
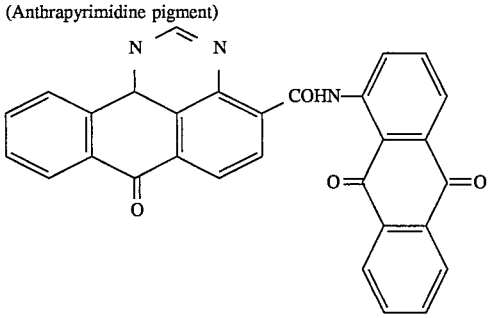

-continued (Azo pigment)

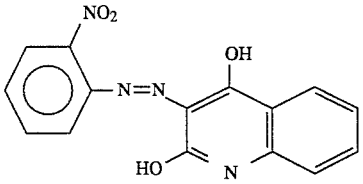

Pigment (37)

(Azo pigment)

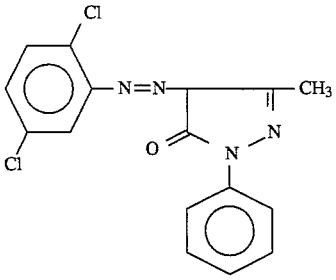

Pigment (38)

(Quinophthalone pigment)

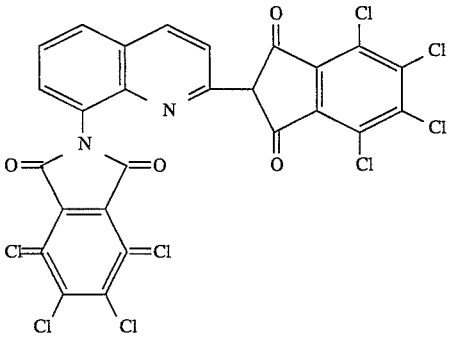

Pigment (40)

(Copper complex salt of azomethine)

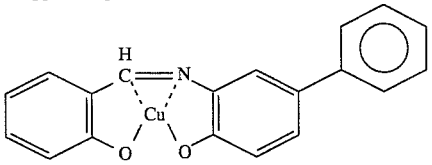

Pigment (41)

(Copper complex salt of azomethine)

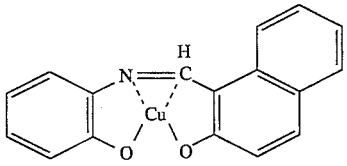

Pigment (42)

In the present invention, the organic solid pigment is used in the form of fine solid dispersion in a hydrophilic binder. Examples of the process for the preparation of such a fine solid dispersion are disclosed in JP-A-59-174830. The average grain diameter of the finely divided organic solid pigment grains preferably is in the range of 0.001 to 5 μm, more preferably 0.01 to 2 μm. Organic pigments according to the present invention may be used singly or in combination. The organic pigment according to the present invention may be finely dispersed in the hydrophilic binder together with other finely dispersible materials to be incorporated in the photographic light-sensitive material (e.g., inorganic pigments such as the foregoing scarcely water-soluble basic metal compounds, organic compounds such as hydrophobic polymer).

In the present invention, the layer in which the organic solid pigment is incorporated is a light-sensitive silver halide emulsion layer and/or its adjacent layer(s). The pigment may be incorporated in a light-sensitive silver halide emulsion layer having any color-sensitivity. In order to avoid the sensitivity drop, it is preferably incorporated in a color-sensitive layer other than the blue-sensitive layer. Examples of adjacent layer in which the organic solid pigment is incorporated include a dye donor-containing layer (e.g., yellow dye donor-containing layer, magenta dye donor-containing layer, cyan dye donor-containing layer) which may be provided additionaly depending on the color sensitivity of the light-sensitive silver halide and an interlayer provided interposed between the light-sensitive silver halide emulsion layer (containing a dye donor) and a light-sensitive silver halide emulsion layer having a different color sensitivity. The organic solid pigment according to the present invention not only incorporated in a single layer but also may be separately incorporated in two or more layers.

A particularly preferred embodiment of the photographic light-sensitive material according to the present invention is a heat-developable color photographic light-sensitive material comprising at least three layers containing at least a light-sensitive silver halide emulsion, a dye-providing compound on a support, emulsions being spectrally sensitized to blue, green and red, respectively, and the organic solid pigment is contained in a layer (interlayer) between the blue-sensitive layer and the green-sensitive layer or between the blue-sensitive layer and the red-sensitive layer.

The amount of the organic pigment according to the present invention to be used depends on the kind of pigment, the kind of dye-providing compound, the intrinsic sensitivity of light-sensitive silver halide, the dispersed condition of pigment, etc. but is normally in the range of 1 mg to 5,000 mg, preferably 10 mg to 1,000 mg per $m^2$ of the light-sensitive material, and preferably in the range of 1 to 200% by weight based on the weight of the binder in the layer containing the organic pigment. When the amount is less than 1 mg per $m^2$ the effects of the present invention can not be obtained sufficiently. On the other hand, it is difficult to incorporate the pigment into the light-sensitive material in an amount of more than 5,000 mg.

In the present invention, as a combination of the scarcely water-soluble basic metal compound used as a base precursor and a compound capable of undergoing complexing reaction with metal ions constituting the basic metal compound in the presence of water as a medium (complexing agent) there may be used one disclosed in JP-A-62-129848 (corresponding to U.S. Pat. No. 4,740,445), and EP 210660A2.

The heat-developable photographic light-sensitive material according to the present invention essentially comprises a light-sensitive silver halide emulsion, a binder and a dye-providing compound on a support. It may further comprises a reducing agent (the reducing agent may serve also as a dye-providing compound as mentioned later), an organic metal salt oxidizer or the like incorporated therein, if desired.

These components are often incorporated in the same layer but may be separately incorporated in various layers. For example, if a colored dye-providing compound is present in layers under the silver halide emulsion layer, it can inhibit the sensitivity drop. The reducing agent is preferably incorporated in the heat-developable photographic light-sensitive material but may be externally supplied. For example, a diffusive reducing agent may be diffused from a dye-fixing material to supply into the light-sensitive material from the outside as mentioned later.

In order to obtain a wide range of colors in the chromaticity diagram from the three primary colors, i.e., yellow, magenta and cyan, at least three silver halide emulsion layers having light-sensitivity in different spectral ranges are used in combination. For example, a combination of a blue-sensitive layer, a green-sensitive layer and a red-sensitive layer, a combination of a green-sensitive layer, a red-sensitive layer and an infrared-sensitive layer, and a combination of a red-sensitive layer, an infrared-sensitive layer (I) and an infrared-sensitive layer (II) (sensitive to light having different wavelength range to which the layer (I) is sensitive) as disclosed in JP-A-59-180550, JP-A-64-13546, and JP-A-62-253159, and EP 479,167 may be used. These light-sensitive layers may be arranged in various orders known in the field of the ordinary type color light-sensitive materials. These light-sensitive layers may each be divided into two or more layers as necessary as described in JP-A-1-252954.

The heat developable light-sensitive material may be provided with various light-insensitive layers such as protective layer, undercoating layer, interlayer, yellow filter layer and antihalation layer between the foregoing silver halide emulsion layers or as an uppermost or lowermost layer, and various auxiliary layers such as backing layer on the opposite side of the support. In some detail, a layer structure as disclosed in the above cited patents, an undercoating layer as disclosed in U.S. Pat. No. 5,051,335, an interlayer containing a solid pigment as disclosed in JP-A-1-167838, and JP-A-61-20943, an interlayer containing a reducing agent or DIR compound as disclosed in JP-A-1-120553, JP-A-5-34884, and JP-A-2-64634, an interlayer containing an electron transfer agent as disclosed in U.S. Pat. Nos. 5,017,454, and 5,139,919, and JP-A-2-235,044, and a protective layer containing a reducing agent as disclosed in JP-A-4-249,245 may be provided singly or in combination.

The support is preferably designed so as to exert an antistatic effect and exhibit a surface resistivity of not more than $10^{12}$ Ω.cm.

The silver halide to be used in the present invention may be any of silver chloride, silver bromide, silver bromoiodide, silver bromochloride, silver chloroiodide and silver bromochloroiodide.

The silver halide emulsion to be used in the present invention may be a surface latent image type emulsion or an internal latent image type emulsion. The internal latent image type emulsion may be used as a direct reversal emulsion when combined with a nucleating agent or light fogging agent. The silver halide emulsion to be used in the present invention may be a so-called core-shell emulsion differing in phase between the interior and exterior of the grain or may have different silver halide compositions connected to each other via an epitaxial junction. The silver halide emulsion may be monodisperse or polydisperse. Monodisperse silver halide emulsions may be used in admixture to control gradation as disclosed in JP-A-1-167743, and JP-A-4-223463. The grain size of silver halide grains is preferably in the range of 0.1 to 2 μm, particularly 0.2 to 1.5 μm. The crystal habit of silver halide grains may be any of regular crystal such as cube, octahedron and tetradecahedron, irregular crystal such as sphere and tabular crystal having a high aspect ratio, crystal having a crystal defect such as twinning plane, composite there and other crystal forms.

Specifically, any of silver halide emulsions prepared by the method as disclosed in U.S. Pat. Nos. 4,500,626 (50th column), and 4,628,021, Research Disclosure (hereinafter referred to as "RD") Nos. 17029 (1978), 17643 (December 1978), pp. 22–23, 18716 (November 1979), page 648, and 307105 (November 1989), pp. 863–865, JP-A-62-253159, JP-A-64-13546, JP-A-2-236546, and JP-A-3-110555, P. Glafkides, *Chemie et Phisique Photographiue*, Paul Montel, 1967, G. F. Duffin, *Photographic Emulsion Chemistry*, Focal Press, 1966, and V. L. Zelikman et al., *Making and Coating Photographic Emulsion,* Focal Press, 1964 may be used.

In the process of preparation of the light-sensitive silver halide emulsion, so-called desalting, i.e., removal of excess salts is preferably conducted. To this end, noodle washing involving gelation of gelatin may be conducted. Alternatively, sedimentation method using an inorganic salt (e.g., sodium sulfate), anionic surface active agent or anionic polymer (e.g., sodium polystyrenesulfonate) comprising polyvalent anions or gelatin derivative (e.g., aliphatic acylated gelatin, aromatic acylated gelatin, aromatic carbamoylated gelatin) may be used. Preferred among these methods is sedimentation method.

The light-sensitive silver halide emulsion to be used in the present invention may comprise heavy metals such as iridium, rhodium, platinum, cadmium, zinc, thallium, lead, iron and osmium for various purposes. These compounds may be used singly or in combination. The amount of such a compound to be added depends on the purpose but is normally in the range of about $10^{-9}$ to $10^{-3}$ mol per mol of silver halide. Such a compound may be uniformly incorporated in grains or may be localized inside or on the surface of grains. In some detail, an emulsion as disclosed in JP-A-2-236542, JP-A-1-116637, and Japanese Patent Application No. 4-126629 is preferably used.

In the step of formation of the light-sensitive silver halide emulsion grains, as a silver halide solvent there may be used a thiocyanate, ammonia, 4-substituted thioether compound, organic thioether derivative as disclosed in JP-B-47-11386 (The term "JP-B" as used herein means an "examined Japanese patent publication") or sulfur-containing compound as disclosed in JP-A-53-144319.

For other conditions, reference can be made to the above cited references, e.g., P. Glafkides, *Chemie et Phisique Photographique*, Paul Montel, 1967, G. F. Duffin, Photoqraphic *Emulsion Chemistry*, Focal Press, 1966, and V. L. Zelikman et al., *Making. and Coating Photographic Emulsion*, Focal Press, 1964. In some detail, the emulsion can be prepared by any of the acid process, the neutral process, the ammonia process, etc. The reaction between a soluble silver salt and a soluble halogen salt can be carried out by any of a single jet process, a double jet process, a combination thereof, and the like.

A method in which grains are formed in the presence of excess silver ions (so-called reverse mixing method) may be used. Further, a so-called controlled double jet process, in which a pAg value of a liquid phase in which silver halide grains are formed is maintained constant, may also be used.

In order to expedite the growth of grains, the concentration, amount or addition rate of silver salts and halides may be raised (as disclosed in JP-A-55-142329, JP-A-55-158124, and U.S. Pat. No. 3,650,757).

The agitation of the reaction solution may be effected by any known agitation method. The temperature and pH of the reaction solution during the formation of silver halide grains may be arbitarily predetermined depending on the purpose. The preferred pH range is from 2.2 to 8.5, more preferably from 2.5 to 7.5.

In general, the light-sensitive silver halide emulsion is a chemically-sensitized silver halide emulsion. The chemical sensitization of the light-sensitive silver halide emulsion according to the present invention, if the emulsion is for an ordinary type photographic light-sensitive materials, may be effected by chalcogen sensitization method such as sulfur sensitization method, selenium sensitization method and tellurium sensitization method, noble metal sensitization method using gold, platinum, palladium or the like, and reduction sensitization method, singly or in combination (as disclosed in JP-A-3-110555, and JP-A-5-241267). The chemical sensitization may be effected in the presence of a nitrogen-containing heterocyclic compound (as disclosed in JP-A-62-253159). A fog inhibitor as described later may be added after the completion of chemical sensitization. In some detail, a method as described in JP-A-5-45833, and JP-A-62-40446 may be used.

The pH value during the chemical sensitization is preferably from 5.3 to 10.5, more preferably from 5.5 to 8.5. The pAg value during the chemical sensitization is preferably from 6.0 to 10.5, more preferably 6.8 to 9.0.

The coated amount of the light-sensitive silver halide emulsion according to the present invention is in the range of 1 mg/m$^2$ to 10 g/m$^2$ as calculated in terms of silver.

In order to make the light-sensitive silver halide emulsion used in the present invention sensitive to green, red and infrared rays, it is subjected to spectral sensitization with a methine dye or the like. If necessary, the blue-sensitive emulsion may be subjected to spectral sensitization to blue range.

Examples of dyes to be used in the spectral sensitization include cyanine dye, melocyanine dye, composite cyanine dye, composite melocyanine dye, holopolar cyanine dye, hemicyanine dye, styryl dye and hemioxonol dye.

Specifically, sensitizing dyes as disclosed in U.S. Pat. No. 4,617,257, JP-A-59-180550, JP-A-64-13546, JP-A-5-45828, and JP-A-5-45834 can be used.

These sensitizing dyes can be used singly or in combination. A combination of these sensitizing dyes is often used particularly for the purpose of wavelength adjustment in supersensitization or spectral sensitization.

Besides these sensitizing dyes, a dye which does not exert a spectral sensitizing effect itself or a compound which does not substantially absorb visible light but exerts a supersensitizing effect may be incorporated in the emulsion (as disclosed in U.S. Pat. No. 3,615,641, and JP-A-63-23145).

The time at which these sensitizing dyes are incorporated in the emulsion may be during or before or after the chemical ripening or may be before or after the nucleation of silver halide grains as disclosed in U.S. Pat. Nos. 4,183,756, and 4,225,666. These sensitizing dyes or supersensitizers may be added in the form of solution in an organic solvent such as methanol, dispersion in gelatin or solution of a surface active agent. The amount of these sensitizing dyes to be added is normally in the range of $10^{-8}$ mole to $10^{-2}$ mole per mole of silver halide.

Additives which can be used in these processes and known photographic additives which can be used in the heat-developable photographic light-sensitive material and dye-fixing (image-receiving) material according to the present invention are also described in the above cited RD Nos. 17643, 18716 and 307105 as tabulated below.

| Kind of additive | RD17643 | RD18716 | RD307105 |
|---|---|---|---|
| 1. Chemical sensitizer | p. 23 | p. 648 right column (RC) | p. 866 |
| 2. Sensitivity increasing agent | | p. 648 right column (RC) | |
| 3. Spectral sensitizer and supersensitizer | pp. 23–24 | p. 648 RC–p. 649 RC | pp. 866–868 |
| 4. Brightening agent | p. 24 | p. 647 RC | p. 868 |
| 5. Antifoggant and stabilizer | pp. 24–25 | p. 649 RC | pp. 868–870 |
| 6. Light absorbent, filter dye, and ultraviolet absorbent | pp. 25–26 | p. 649 RC–p. 650 Left Column (LC) | p. 873 |
| 7. Dye image stabilizer | p. 25 | p. 650 LC | p. 872 |
| 8. Hardening agent | p. 26 | p. 651 LC | pp. 874–875 |
| 9. Binder | p. 26 | p. 651 LC | pp. 873–874 |
| 10. Plasticizer and lubricant | p. 27 | p. 650 RC | p. 876 |
| 11. Coating aid and surface active agent | pp. 26–27 | p. 650 RC | pp. 875–876 |
| 12. Antistatic agent | p. 27 | p. 650 RC | pp. 876–877 |
| 13. Matting agent | | | pp. 878–879 |

As the binder to be contained in the heat-developable photographic light-sensitive material or dye-fixing material, a hydrophilic binder is preferably used. Examples of such a hydrophilic binder include those described in the above cited RD's and JP-A-64-13546, pp. 71–75. Specifically, a transparent or semitransparent hydrophilic binder is preferred. Examples of such a transparent or semitransparent hydrophilic binder include proteins such as gelatin and gelatin derivative, natural compounds such as polysaccharides, for example, cellulose derivatives, starch, gum arabic, dextran, and pullulan, and synthetic high molecular compounds such as polyvinyl alcohol, polyvinyl pyrrolidone and acrylamide. Further, a high water absorption polymer as disclosed in U.S. Pat. No. 4,960,681, and JP-A-62-245260, i.e., homopolymer of vinyl monomer having —COOM or —$SO_3M$ (in which M is a hydrogen atom or alkaline metal atom) or copolymer of such vinyl monomers or copolymer of such vinyl monomers with other vinyl monomers (e.g., sodium methacrylate, ammonium methacrylate, Sumikagel L-5H ( trade name) available from Sumitomo Chemical Co., Ltd.) may be used. Two or more of these binders may be used in combination. In particular, a combination of gelatin and the foregoing binders is preferred. Gelatin may be selected from the group consisting of lime-treated gelatin, acid-treated gelatin and so-called delimed gelatin having a reduced content of calcium or the like depending on various purposes. These gelatins may be preferably used in combination.

In the system where heat development is effected with the supply of a slight amount of water, if the foregoing high water absorption polymer is used, water absorption can be rapidly effected. Further, if a high water absorption polymer is incorporated in the dye-fixing layer or its protective layer, the dyes can be prevented from being re-transferred from the dye-fixing element to other elements after transfer.

In the present invention, the amount of the binder to be coated is preferably not more than 20 $g/m^2$, particularly not more than 10 $g/m^2$, more preferably not more than 0.5 $g/m^2$ to 7 $g/m^2$.

In the present invention, the light-sensitive element may comprise an organic metal salt as an oxidizer in combination with the light-sensitive silver halide emulsion. Particularly preferred among these organic metal salts are organic silver salts.

Examples of organic compounds which can be used to form such an organic silver salt as an oxidizer include benzotriazoles and aliphatic acids as disclosed in U.S. Pat. No. 4,500,626, 52nd column to 53rd column, and other compounds. Other useful examples of organic compounds include silver acetylene as described in U.S. Pat. No. 4,775,613. Two or more of organic silver salts may be used in combination.

The above mentioned organic silver salt can be used preferably in an amount of 0.01 to 10 mole, more preferably 0.01 to 1 mole per mole of light-sensitive silver halide. The sum of the coated amount of light-sensitive silver halide and organic silver salt is preferably in the range of 0.05 $mg/m^2$ to 10 $g/m^2$, more preferably 0.1 $g/m^2$ to 4 $g/m^2$ as calculated in terms of silver.

As the reducing agents to be used in the present invention, those known in the field of heat-developable light-sensitive materials can be used. Reducing dye providing compounds as described later can also be used (in this case, other reducting agents can be used in combination there with). Further, a precursor of a reducing agent which exhibits no reducing effect itself but exerts a reducing effect when acted by a nucleophilic reagent or heat during development can be used.

Examples of reducing agents which can be used in the present invention include reducing agents and precursors thereof as disclosed in U.S. Pat. Nos. 4,500,626 (49th column–50th column), 4,839,272, 4,330,617, 4,590,152, 5,017,454, and 5,139,919, JP-A-60-140335, pp. 17–18, JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-128540, JP-A-60-181742, JP-A-61-259253, JP-A-62-201434, JP-A-62-244044, JP-A-62-131253, JP-A-62-131256, JP-A-63-10151, JP-A-64-13546 (pp. 40–57), JP-A-1-120553, JP-A-2-32338, JP-A-2-35451, JP-A-2-234158, and JP-A-3-160443, and EP 220,746, pp. 78–96.

A combination of various reducing agents as disclosed in U.S. Pat. No. 3,039,869 can be used.

In the case where a nondiffusing reducing agent is used, an electron transfer agent and/or electron transfer agent precursor can be optionally used in combination therewith to accelerate the migration of electrons between the nondiffusing reducing agent and the developable silver halide. In particular, those disclosed in the above cited U.S. Pat. No. 5,139,919, EP 418,743, and JP-A-1-138556, and JP-A-3-102345 are preferably used. Further, a method for stable incorporation in layers as disclosed in JP-A-2-230143, and JP-A-2-235044 may be preferably used.

Such an electron transfer agent or precursor thereof can be selected from the above mentioned reducing agents or precursors thereof. The electron transfer agent or precursor thereof preferably exhibits a greater mobility than the nondiffusing reducing agent (electron donor). Particularly useful electron transfer agents are 1-phenyl-3-pyrazolidones and aminophenols.

The nondiffusing reducing agent (electron donor) to be used in combination with the electron transfer agent can be selected from among the above mentioned reducing agents which substantially do not migrate in the layers constituting light-sensitive material. Preferred examples of such nondiffusing reducing agents include hydroquinones, sulfonamidophenols, sulfonamidonaphtholes, compounds described as electron donors in JP-A-53-110827 and U.S. Pat. Nos. 5,032,487, 5,026,634, and 4,839,272, and nondiffusing reducing dye-providing compounds as described later.

Further, an electron donor precursor as disclosed in JP-A-3-160443 may be preferably used.

Moreover, the interlayer and protective layer may comprise the foregoing reducing agents incorporated therein for various purposes such as prevention of color mixing, improvement in color reproducibility, improvement in the properties of white background and prevention of silver migration to the dye-fixing material. Specifically, reducing agents as disclosed in EP 524,649, EP 357,040, JP-4-249245, JP-A-2-64633, JP-A-2-46450, and JP-A-63-186240 are preferably used. Further, development inhibitor-releasing reducing compounds as disclosed in JP-B-3-63733, JP-A-1-150135, JP-A-2-110557, JP.A-2-64634, JP-A-3-43735, and EP 451,833 may be used.

In the present invention, the total amount of the reducing agents to be incorporated into the light-sensitive material is preferably in the range of 0.01 to 20 mol, particularly 0.1 to 10 mol per mol of silver in the light-sensitive material.

In the present invention, as an image-forming substance a compound which produces or releases a mobile dye in correspondence or counter correspondence to the reaction of the reduction of silver ion to silver at a high temperature, i.e., a dye providing compound is used.

Examples of dye providing compounds which can be used in the present invention include compounds (couplers) which undergo oxidative coupling reaction to form a dye. These couplers may be two-equivalent or four-equivalent. Further, two-equivalent couplers containing a nondiffusing group as a releasing group, which undergo oxidative coupling reaction to form a diffusive dye can be previously used. These nondiffusing groups may form a polymer chain. Specific examples of color developing agents and couplers are further described in T. H. James, *The Theory of the Photographic Process,* 4th ed., pp. 291–334 and pp. 354–361, RD-307,105, P871, JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, and JP-A-60-66249.

Another example of dye providing compound is a compound which serves to imagewise release or diffuse a diffusive dye. This type of a compound can be represented by the following general formula (LI):

$$((\text{Dye})_m\text{—Y})_n\text{—Z} \qquad \text{(LI)}$$

wherein Dye represents a dye group, or a dye group or dye precursor group which has been temporarily shifted to short wavelength; Y represents a mere bond or linking group; Z represents a group which makes difference in the diffusibility of the compound represented by $((\text{Dye})_m\text{—Y})_n\text{—Z}$ or releases $(\text{Dye})_m\text{—Y}$ to make difference in diffusibility from $((\text{Dye})_m\text{—Y})_n\text{—Z}$ in correspondence or counter correspondence to a light-sensitive silver salt having an imagewise latent image; m represents an integer 1 to 5; and n represents an integer 1 or 2, with the proviso that when either m or n is not 1, the plurality of Dye's may be the same or different.

Specific examples of the dye providing compound represented by the general formula (LI) include the following compounds (1) to (5). The compounds (1) to (3) form a diffusive dye image (positive dye image) in counter correspondence to the development of silver halide. The compounds (4) and (5) form a diffusive dye image (negative dye image) in correspondence to the development of silver halide.

(1) Dye developing agents in which a hydroquinone developing agent and a dye moiety are connected to each other as disclosed in U.S. Pat. Nos. 3,134,764, 3,362,819, 3,597,200, 3,544,545, and 3,482,972, and JP-B-3-68387. These dye developing agents are diffusive under alkaline conditions but react with silver halide to become nondiffusing.

(2) As described in U.S. Pat. No. 4,503,137, nondiffusing compounds can be used which release a diffusive dye under alkaline conditions but react with silver halide to lose its capability. Examples of such nondiffusing compounds include compounds which undergo intramolecular nucleophilic substitution reaction to release a diffusive dye as disclosed in U.S. Pat. No. 3,980,479, and compounds which undergo intramolecular rearrangement reaction of isooxazolone rings to release a diffusive dye as disclosed in U.S. Pat. No. 4,199,354.

(3) As disclosed in U.S. Pat. Nos. 4,559,290, and 4,783,396, European Patent 220,746A2, Kokai Giho 87-6199, and JP-A-64-13546, nondiffusing compounds can be used which react with a reducing agent left unoxidized upon development to release a diffusive dye.

Examples of such nondiffusing compounds include compounds which undergo intramolecular nucleophilic substitution reaction after reduction to release a diffusive dye as described in U.S. Pat. Nos. 4,139,389, and 4,139,379, and JP-A-59-185333, and JP-A-57-84453, compounds which undergo intramolecular electron migration reaction after reduction to release a diffusive dye as described in U.S. Pat. No. 4,232,107, JP-A-59-101649, and JP-A-61-88257, and RD24025 (1984), compounds which undergo release of single bond after reduction to release a diffusive dye as described in West German Patent 3,008,588A, JP-A-56-142530, and U.S. Pat. Nos. 4,343,893, and 4,619,884, nitro compounds which release a diffusive dye after receiving electrons as described in U.S. Pat. No. 4,450,223, and compounds which release a diffusive dye after receiving electrons as described in U.S. Pat. No. 4,609,610.

More preferred examples of such nondiffusing compounds include compounds containing N—X bond (in which X represents oxygen, sulfur or nitrogen atom) and an electron withdrawing group in molecule as disclosed in European Patent 220,746, Kokai Giho 87-6199, U.S. Pat. No. 4,783,396, and JP-A-63-201653, JP-A-63-201654, and JP-A-64-13546, compounds containing $SO_2$—X bond (in which X is as defined above) and an electron withdrawing group per molecule as disclosed in JP-A-1-26842, compounds containing PO—X bond (in which X has the same meaning as above) and an electron withdrawing group per molecule as disclosed in JP-A-63-271344 and compounds containing C—X' bond (in which X' has the same meaning as X or represents —$SO_2$—) and an electron withdrawing group per molecule as disclosed in JP-A-63-271341. Compounds which undergo cleavage of single bond after reduction by $\pi$ bond conjugated with electron accepting group to release a diffusive dye as disclosed in JP-A-1-161237 and JP-A-1-161342 can also be used.

Particularly preferred among these compounds are compounds containing N—X bond and an electron withdrawing group per molecule. Specific examples of these compounds include Compounds (1) to (3), (7) to (10), (12), (13), (15), (23) to (26), (31), (32), (35), (36), (40), (41), (44), (53) to (59), (64), and (70) as disclosed in European Patent 220,746 or U.S. Pat. No. 4,783,396, Compounds (11) to (23) as disclosed in Kokai Giho 87-6199, and Compounds (1) to (84) as disclosed in JP-A-13546.

(4) Coupler compounds containing a diffusive dye as a releasing group which undergo reaction with an oxidised product of a reducing agent to release a diffusive dye (DDR couplers). Specific examples of such DDR couplers are described in British Patent 1,330,524, JP-B-48-39165, and U.S. Pat. Nos. 3,443,940, 4,474,867, and 4,483,914.

(5) Compounds which are capable of reducing silver halides or organic silver salts and release a diffusive dye when reducing the silver halides or organic silver salts (DRR compounds). These compounds do not require the use of other reducing agents, eliminating the stain on the image with an oxidative decomposition product of reducing agents. Typical examples of such DRR compounds are described in U.S. Pat. Nos. 3,928,312, 4,053,312, 4,055,428, 4,336,322, 3,725,062, 3,728,113, 3,443,939, and 4,500,626, JP-A-56-65839, JP-A-59-69839, JP-A-53-3819, JP-A-51-104343, JP-A-58-116537, and JP-A-57-179840, and RD17465. Specific examples of these DRR compounds include compounds as disclosed in U.S. Pat. No. 4,500,626, 22nd column–44th column. Particularly preferred among these compounds are Compounds (1) to (3), (10) to (13), (16) to (19), (28) to (30), (33) to (35), (38) to (40), and (42) to (64). Further, compounds as described in U.S. Pat. No. 4,639,408, 37th column to 39th column, are useful. As dye providing compounds other than the above mentioned couplers and dye providing compounds represented by the general formula (LI), dye silver compounds in which an organic silver salt and a dye are connected to each other (Research Disclosure, May 1978, pp. 54–58), azo dyes for use in heat development silver dye bleaching process (U.S. Pat. No. 4,235,957, Research Disclosure, Apr. 1976, pp. 30–32), and leuco dyes (U.S. Pat. Nos. 3,985,565, and 4,022,617) can be used.

The incorporation of a hydrophobic additive such as a dye providing compound and a nondiffusing reducing agent into the layers constituting the light-sensitive material can be accomplished by any known method, for example, a method disclosed in U.S. Pat. No. 2,322,027. In this case, a high boiling organic solvent as disclosed in U.S. Pat. Nos. 4,555,470, 4,536,466, 4,536,467, 4,587,206, 4,555,476, and 4,599,296, and JP-B-3-62256 can be used in combination with an organic solvent having a boiling point as low as 50° C. to 160° C. as necessary. Two or more of these dye-providing compounds, nondiffusing reducing agents and high boiling organic solvents may be used in combination.

The amount of the high boiling organic solvent to be used is preferably in the range of 10 g or less, more preferably 5 g or less, particularly preferably 1 g to 0.1 g per g of dye providing compound used or 1 ml or less, more preferably 0.5 ml or less, particularly 0.3 ml or less per g of binder used.

Alternatively, a dispersion process using a polymer as described in JP-B-51-39853 (the term "JP-B" as used herein means an "examined Japanese patent publication"), and JP-A-51-59943 or a process which comprises the incorporation in the form of fine dispersion as disclosed in JP-A-62-30242 can be used.

A compound substantially insoluble in water can be finely dispersed in the binder rather than using the above mentioned methods.

When a hydrophobic compound is dispersed in a hydrophilic colloid, various surface active agents can be used. For example, compounds disclosed as surface active agents in JP-A-59-157636, pp. 37–38, and the above cited RD's can be used.

In the heat-developable photographic light-sensitive material according to the present invention, a compound which not only activates development but also stabilizes an image may be incorporated in the light-sensitive material. Specific examples of such compounds which can be preferably used are described in U.S. Pat. No. 4,500,626, 51st column to 52nd column.

In the system wherein an image is formed by the diffusion transfer of a dye, various compounds may be incorporated in the layers constituting the heat-developable photographic light-sensitive material for the purpose of fixing or making undesirable dyes or colored matters colorless to improve the properties of the white background of the resulting image.

In some detail, compounds as disclosed in EP 353,741, EP 461,416, and JP-A-63-163345, and JP-A-62-203158 may be used.

The layers constituting the heat-developable photographic light-sensitive material according to the present invention can also comprise various pigments or dyes other than disclosed hereinabove incorporated therein for the purpose of improving color separatability or raising sensitivity.

In some detail, compounds as disclosed in the above cited RD's, and compounds and layer structures as disclosed in EP 479,167, EP 502,508, JP-A-1-167838, JP-A-4-343355, JP-A-2-168252, and JP-A-61-20943 may be used.

In the system where an image is formed by the diffusion transfer of a dye, a dye-fixing material is used in combination with the heat-developable photographic light-sensitive material. The dye-fixing material may be separately coated on a support different from that for the photographic light-sensitive material or may be coated on the same support as the photographic light-sensitive material. For the relationship between the photographic light-sensitive material and the dye-fixing material, between the photographic light-sensitive material and the support and between the photographic light-sensitive material and the white reflective layer, those disclosed in U.S. Pat. No. 4,500,626 (57th column) can apply to the present invention.

The dye-fixing material which can be preferably used in the present invention comprises at least one layer containing a mordant and a binder. Mordants which are conventionally known in the art may be used. Specific examples of such a mordant include mordants as disclosed in U.S. Pat. No. 4,500,626, 58th to 59th columns, and JP-A-61-88256, pp. 32–41, and JP-A-1-161236, pp. 4–7, and mordants as disclosed in U.S. Pat. Nos. 4,774,162, 4,619,883, and 4,594,308. Further, dye-accepting high molecular compounds as disclosed in U.S. Pat. No. 4,463,079 may be used.

The foregoing hydrophilic binder may be preferably used as the binder to be incorporated in the dye-fixing material. Further, carrageenans (as a thickener) as disclosed in EP 443,529 and latexes having a glass transition temperature of not higher than 40° C. as disclosed in JP-B-3-74820 may be preferably used as well.

The dye-fixing material may comprise auxiliary layers such as protective layer, peeling layer, undercoating layer, interlayer, backing layer and anticurling layer as necessary. In particular, a protective layer is advantageously provided.

The layers constituting the heat-developable photographic light-sensitive material and dye fixing material can comprise a plasticizer, a slide agent or a high boiling organic solvent as an agent for improving the peelability between the light-sensitive material and the dye fixing material. Specific examples of these agents include those described in the above cited RD's and JP-A-62-245253.

Further, for the above mentioned purposes, various silicone oils (ranging from dimethyl silicone oil to modified silicone oils obtained by introducing various organic groups into dimethyl siloxane) can be used. Useful examples of such silicone oils are various modified silicone oils described in "Modified Silicone Oil" (technical data published by Shin-Etsu Silicone Co., Ltd.), page 6–18B, particularly carboxy-modified silicone (trade name: X-22-3710).

Further, silicone oils as disclosed in JP-A-62-215953, and JP-A-63-46449 can also be effectively used.

The heat-developable photographic light-sensitive material or dye fixing material may comprise a discoloration inhibitor. Examples of such a discoloration inhibitor include oxidation inhibitor, ultraviolet absorbent, and various metal complexes. Dye image stabilizers and ultraviolet absorbents as disclosed in the above cited RD's are useful as well.

Examples of such an oxidation inhibitor include chroman compounds, coumaran compounds, phenol compounds (e.g., hindered phenols), hydroquinone derivative, hindered amine derivative, and spiroindan compounds. Further, compounds as described in JP-A-61-159644 can also be effectively used as oxidation inhibitors.

Examples of ultraviolet absorbents to be used as discoloration inhibitors include benzotriazole compounds as disclosed in U.S. Pat. No. 3,533,794, 4-thiazolidone compounds as disclosed in U.S. Pat. No. 3,352,681, benzophenone compounds as disclosed in JP-A-46-2784, and compounds as disclosed in JP-A-54-48535, JP-A-62-136641, and JP-A-61-88256. Further, ultraviolet-absorbing polymers as disclosed in JP-A-62-260152 can also be effectively used as ultraviolet absorbents.

Examples of metal complexes to be used as discoloration inhibitors include compounds as disclosed in U.S. Pat. Nos. 4,241,155, 4,245,018, 3rd column–36th column, and 4,254, 195, 3rd column–8th column, and JP-A-62-174741, JP-A-61-88256, pp. 27–29, JP-A-63-199248, JP-A-1-75568, and JP-A-1-74272.

The discoloration inhibitor for inhibiting the transfer of a dye which has been transferred to the dye fixing material may be previously incorporated in the dye fixing material or supplied into the dye fixing material externally, e.g., from the light-sensitive material or a transferring solvent as described hereinafter.

The above mentioned oxidation inhibitors, ultraviolet absorbents and metal complexes may be used in combination.

The heat-developable photographic light-sensitive material or dye fixing material may comprise a fluorescent brightening agent. In particular, such a fluorescent brightening agent is preferably incorporated in the dye fixing material or supplied into the dye fixing material externally, e.g., from the light-sensitive material or a transferring solvent. Examples of such a fluorescent brightening agent include compounds as disclosed in K. Veenkataraman, *The Chemistry of Synthetic Dyes,* vol. V, Chapter 8, and JP-A-61-143752. Specific examples of such a fluorescent brightening agent include stilbene compounds, coumarine compounds, biphenyl compounds, benzoxazolyl compounds, naphthalimide compounds, pyrazoline compounds, and carbostyryl compounds.

Such a fluorescent brightening agent can be used in combination with a discoloration inhibitor or ultraviolet absorbent.

Specific examples of these discoloration inhibitors, ultraviolet absorbents and fluorescent brightening agents are disclosed in JP-A-62-215272, pp. 125–137, and JP-A-1-161236, pp. 17–43.

Examples of film hardeners to be incorporated in the layers constituting the heat-developable photographic light-sensitive material or dye fixing material include those described in the above cited RD's, U.S. Pat. Nos. 4,678,739, 41st column, 4,791,042, JP-A-59-116655, JP-A-62-245261, JP-A-61-18942, and JP-A-4-218044. Specific examples of such film hardeners include aldehyde film hardeners (e.g., formaldehyde), aziridine film hardeners, epoxy film hardeners, vinylsulfone film hardeners (e.g., N,N'-ethylenebis(vinylsulfonylacetamido)ethane), N-methylol film hardeners (e.g., dimethylolurea), and high molecular film hardeners (e.g., compounds as described in, for example, JP-A-62-234157).

Such a film hardener is preferably used in an amount of 0.001 g to 1 g, more preferably 0.005 g to 0.5 g per g of gelatin coated in the light-sensitive material. Such a film hardener may be incorporated in any of the layers constituting the light-sensitive material or dye-fixing material or may be separately incorporated in two or more layers.

The layers constituting the heat-developable photographic light-sensitive material or dye-fixing material may comprise various fog inhibitors, photographic stabilizers, or precursors thereof. Specific examples of these compounds are disclosed in the above cited RD's, U.S. Pat. Nos. 5,089,378, 4,500,627, 4,614,702, 4,775,610, 4,626,500, 4,983,494, JP-A-64-13546, pp. 7–9, pp. 57–71, pp. 81–97, JP-A-62-174747, JP-A-62-239148, JP-A-63-264747, JP-A-1-150135, JP-A-2-110557, JP-A-2-178650, and RD 17,643 (1978), pp. 24–25.

These compounds are preferably used in an amount of $5\times10^{-6}$ to $1\times10^{-1}$ mol, more preferably $1\times10^{-5}$ to $1\times10^{-2}$ mol per mol of silver.

The layers constituting the heat-developable photographic light-sensitive material or dye fixing material can comprise various surface active agents for the purpose of aiding coating, improving peelability and slip properties, inhibiting electrification, accelerating development or like purposes. Specific examples of such surface active agents are described in, for example, the above cited RD's, JP-A-62-173463, and JP-A-62-183457.

The layers constituting the heat-developable photographic light-sensitive material or dye fixing material can comprise an organic fluoro compound incorporated therein for the purpose of improving slip properties and peelability, inhibiting electrification or like purposes. Typical examples of such an organic fluoro compound include fluoro surface active agents as disclosed in, for example, JP-B-57-9053, 8th to 17th columns, JP-A-61-20944, and JP-A-62-135826, and hydrophobic fluorine compounds such as oily fluorinic compound, e.g., fluorine oil, and solid fluorine compound resin, e.g., ethylene tetrafluoride resin.

The heat-developable photographic light-sensitive material or dye fixing material can comprise a matting agent for the purpose of inhibiting adhesion, improving slip properties, making the surface nonglossy or like purposes. Examples of such a matting agent include silicon dioxide, polyolefin and polymethacrylate as described in JP-A-61-88256, P29, and benzoguanamine resin beads, polycarbonate resin beads and AS resin beads as described in JP-A-63-274944, and JP-A-63-274952. Further, compounds as disclosed in the above cited RD's may be used. These matting agents may be incorporated not only in the uppermost layer (protective layer) but also in lower layers as necessary.

In addition, the layers constituting the heat-developable photographic light-sensitive material and dye fixing material may comprise a heat solvent, an anti-foaming agent, a bacteriacide, a mildewproofing agent, a colloidal silica, etc. These additives are further described in JP-A-61-88256, pp. 26–32, JP-A-3-11338, and JP-B-2-51496.

In the present invention, the heat-developable photographic light-sensitive material and/or dye fixing material can comprise an image formation accelerator. Such an image formation accelerator serves to accelerate the redox reaction of a silver salt oxidizing agent and a reducing agent, accelerate reaction such as production or decomposition of a dye from a dye providing substance and release of a diffusive dye from a dye providing substance or accelerate the migration of a dye from the heat-developable photographic light-sensitive material layer to the dye fixing layer. From the standpoint of physicochemical function, the image formation accelerator can be classified as base or base precursor, nucleophilic compound, high boiling organic solvent (oil), heat solvent, surface active agent, compound interacting with silver or silver ion, etc. However, these substance groups normally have composite functions and exert some of these accelerating effects in combination. These image formation accelerators are further described in U.S. Pat. No. 4,678,739, 38th column–40th column.

Examples of base precursors include salts of organic acid and base which undergo decarboxylation on heating, and compounds which undergo intramolecular nucleophilic substitution reaction, Lossen rearrangement or Beckman rearrangement to release amines. Specific examples of such base precursors are disclosed in U.S. Pat. Nos. 4,511,493, and 4,657,848.

In the system where heat development and dye transfer are simultaneously effected in the presence of a small amount of water, a base and/or base precursor is preferably incorporated in the dye-fixing material to enhance the preservability of the heat-developable photographic light-sensitive material.

In addition to the foregoing base precursors, a combination of a scarcely soluble metal compound and a compound capable of undergoing complexing reaction with metal ions constituting the scarcely soluble metal compound (i.e., complexing compound) as disclosed in EP 210,660, and U.S. Pat. No. 4,740,445 and a compound which undergoes electrolysis to produce a base as disclosed in JP-A-61-232451 may be used as base precursors. In particular, the former is effective. The scarcely soluble metal compound and the complexing compound are advantageously incorporated separately in the heat-developable photographic light-sensitive material and the dye-fixing material as disclosed in the foregoing patents.

In the present invention, the heat-developable light-sensitive material and/or dye fixing material may comprise various development stopping agents for the purpose of obtaining an invariably constant image quality against the fluctuation of processing temperature and time during development.

The development stopping agent is a compound which rapidly neutralizes or reacts with a base after a proper development to reduce the base concentration in the film to stop development or a compound which interacts with silver or a silver salt after a proper development to inhibit development. Specific examples of such a development stopping agent include an acid precursor which releases an acid under heating, an electrophilic compound which undergoes substitution reaction with a base present therewith under heating, a nitrogen-containing heterocyclic compound, and a mercapto compound and precursor thereof. These compounds are further described in JP-A-62-253159, pp. 31–32.

In the present invention, as the support for the heat-developable light-sensitive material and dye fixing material there can be used any support material which can withstand the processing temperature. In general, photographic supports such as paper and synthetic high molecular compounds (film) as disclosed in *Shashin Kogaku no Kiso-Ginen Shashin hen* (*Base of Photographic Engineering—A book of Silver Salt Photography*), Society of Photographic Science of Japan, Corona Co., Ltd., 1979, pp. 223–240, are used. Examples of such support materials include polyethylene terephthalate, polyethylene naphthalate, polycarbonate, polyvinyl chloride, polystyrene, polypropylene, polyimide, cellulose (e.g., triacetyl cellulose), support materials obtained by incorporating a pigment such as titanium oxide in these films, paper obtained by film process synthesis of polypropylene, mixed paper made from a synthetic resin pulp such as polyethylene and a natural pulp, Yankee paper, baryta paper, coated paper (particularly cast coat paper), metal, cloth, and glass.

These support materials can be used directly or in the form of laminate with a synthetic high molecular compound such as polyethylene on one or both sides thereof. The laminate layer may comprise a pigment or dye such as titanium oxide, ultramarine and carbon black incorporated therein.

Besides these support materials, support materials as disclosed in JP-A-62-253159, pp. 29–31, JP-A-1-161236, pp. 14–17, JP-A-63-316848, JP-A-2-22651, JP-A-3-56955, and U.S. Pat. No. 5,001,033 can be used.

Onto the surface of these support materials may be coated a hydrophilic binder, an oxide of semiconducting metal such as alumina sol and tin oxide, carbon black, and other antistatic agents.

The surface of these supports may be preferably subjected to various surface treatments or undercoating for the purpose of improving the adhesivity to the hydrophilic binder.

Examples of methods for imagewise exposing the heat-developable photographic light-sensitive material to record an image thereon include a method which comprises directly photographing scene or persons using a camera or the like, a method which comprises exposure through a reversal film or negative film using a printer or enlarger, a method which comprises scanning exposure to an original image through a slit using an exposing apparatus in a copying machine, a method which comprises exposure to light emitted by a light emitting diode or various lasers (e.g., laser diode, gas laser) excited by an electrical signal representative of image data (as disclosed in JP-A-2-129625, Japanese Patent Application Nos. 3-338182, 4-9388, and 4-281442), and method which comprises exposure directly or through an optical system to image data outputted to an image display apparatus such as CRT, liquid crystal display, electroluminescence display and plasma display.

Examples of light sources to be used in recording an image on the heat-developable light-sensitive material include natural light, tungsten lamp, light emitting diode, laser, CRT, and other light sources as described in U.S. Pat. No. 4,500,626, 56th column, JP-A-2-53378, and JP-A-2-54672.

Further, a wavelength conversion element in which a nonlinear optical material is combined with a coherent light source such as laser can be used to effect imagewise exposure. The nonlinear optical material is a material capable of developing nonlinearity between polarization and electric field created when a strong photoelectric field such as laser is given. Inorganic compounds such as lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds as described in JP-A-61-53462 and JP-A-62-210432. As wavelength conversion elements there have been known single crystal light guide type wavelength conversion element, fiber type wavelength conversion element, etc. Any of these types of wavelength conversion elements can be effectively used.

Examples of the image data which can be used include image signal obtained from a video camera, an electronic still camera, etc., television signal stipulated by National Television Signal Code (NTSC), image signal obtained by dividing an original image into many pixels by a scanner, and image signal produced by computers such as CG and CAD.

The heat-developable light-sensitive material and/or dye-fixing material according to the present invention may comprise an electrically conductive heating element layer as a heating means for heat development and diffusion transfer of dye. In this embodiment, as such a heating element those disclosed in JP-A-61-145544 may be used.

The heating temperature at the heat development process is normally in the range of about 50° C. to 250° C., particularly about 60° C. to 180° C. The diffusion transfer of a dye may be effected at the same with or after the heat development process. In the latter case, the transfer of a dye can be effected at a heating temperature ranging from the heat development temperature to room temperature, particularly preferably 50° C. to a temperature about 10° C. lower than the heat development temperature.

The migration of a dye can be effected by heat alone. In order to accelerate the migration of a dye, a solvent may be used. As described in detail in U.S. Pat. Nos. 4,704,345, 4,740,445, and JP-A-61-238056, the system is preferably heated in the presence of a small amount of a solvent (particularly water) to simultaneously or continuously effect development and transfer. In this process, the heating temperature is preferably from 50° C. to a temperature lower than the boiling point of the solvent, e.g., 50° to 100° C. if the solvent is water.

Examples of solvents to be used in the acceleration of development and/or diffusion transfer of a dye to the dye fixing layer include water, and a basic aqueous solution containing an inorganic alkaline metal salt or organic base (these bases include those described with reference to the image formation accelerator). Further, a low boiling solvent, and a mixture of a low boiling solvent and water or the foregoing basic aqueous solution may be used. Moreover, a surface active agent, a fog inhibitor, a complexing compound with a scarcely soluble metal salt, a preservative, a germicide, etc. may be contained in these solvents.

As the solvent employed in the heat development and diffusion transfer processes, water is preferably used. Any commonly used water may be used. Specific examples of water employed in the present invention include distilled water, tap water, well water, and mineral water. In the heat developing apparatus for the heat-developable photographic light-sensitive material and dye-fixing material according to the present invention, water may be used up or may be recycled. In the latter case, water containing components eluted from the photographic materials is reused. Further an apparatus and water as disclosed in JP-A-63-144354, JP-A-63-144355, JP-A-62-38460, and JP-A-3-210555 may be used.

These solvents may be provided to either or both of the heat-developable photographic light-sensitive material and the dye fixing material. The amount of these solvents to be used may be not more than (and preferably at least 10% of) the weight of the solvent corresponding to the maximum solvent volume absorbable by the all coated films.

In order to provide these solvents to the heat-developable photographic light-sensitive layer or dye fixing layer, a method as disclosed in JP-A-62-253159, page 5, and JP-A-63-85544 can be used. Alternatively, these solvents may be previously in either or both of the heat-developable photographic light-sensitive material and the dye fixing element in the form of microcapsules or a hydrate.

The temperature of water to be provided to these photographic materials may be from room temperature to 60° C. as disclosed in the above cited JP-A-63-85544. In particular, the temperature of water is advantageously kept to not lower than 45° C. for the purpose of inhibiting the proliferation of various germs therein.

In order to accelerate the migration of a dye, a hydrophilic heat solvent which stays solid at normal temperature but becomes soluble at an elevated temperature may be incorporated in the heat-developable light-sensitive material and/or dye fixing material. The layer in which the hydrophilic heat solvent is incorporated may be any of a light-sensitive silver halide emulsion layer, an interlayer, protective layer and a dye fixing layer, preferably a dye fixing layer and/or its adjacent layers.

Examples of such a hydrophilic heat solvent include ureas, pyridines, amides, sulfonamides, imides, alcohols, oxims, and other heterocyclic compounds.

Examples of the heating means at the development and/or transfer process include method which comprises bringing the material into contact with a heated block or plate, a hot plate, a hot presser, heat rollers, a heat drum, a halogen lamp heater, an infrared lamp heater, a far infrared lamp heater, etc., and method which comprises passing the material through a high temperature atmosphere. As the process for the lamination of the heat-developable light-sensitive material and the dye-fixing material, the method described in JP-A-61-147244, page 27 can be used. The processing of the photographic elements of the present invention can be accomplished by means of any of various heat development apparatus. For example, apparatus as described in JP-A-59-75247, JP-A-59-177547, JP-A-59-181353, JP-A- 60-18951, JP-A-U-62-25944, and Japanese Patent Application Nos. 4-277517, 4-243072, and 4-244693 may be preferably used. Examples of commercially available heat development apparatus which can be used in the present invention include Pictrostat 100, Pictrostat 200, Pictrography 3000, and Pictrography 2000 available from Fuji Photo Film Co., Ltd.

The present invention will be further described in the following examples, but the present invention should not be construed as being limited thereto.

EXAMPLE 1

A process for the preparation of a dispersion of zinc hydroxide is described below.

12.5 g of zinc hydroxide grains having an average grain size of 0.02 μm, 1 g of carboxylmethyl cellulose as a dispersant, and 0.1 g of sodium polyacrylate were added to 100 ml of a 4% aqueous solution of gelatin. The mixture was ground with glass beads having an average grain diameter of 0.75 mm by means of a mill for 30 minutes. The glass beads were then removed from the mixture to obtain a dispersion of zinc hydroxide.

A process for the preparation of a dispersion of an electron transfer agent is described below.

10 g of an electron transfer agent having the following structural formula, 0.5 g of a polyethylene glycol nonylphenyl ether as a dispersant, and 0.5 g of an anionic surface active agent having the following structural formula were added to 100 ml of a 5% aqueous solution of gelatin. The mixture was then ground with glass beads having an average grain diameter of 0.75 mm by means of a mill for 60 minutes. The glass beads were then removed from the mixture to obtain a dispersion of the electron transfer agent having an average grain diameter of 0.35 μm.

Electron transfer agent

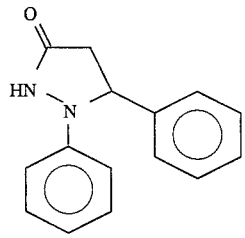

Anionic surface active agent

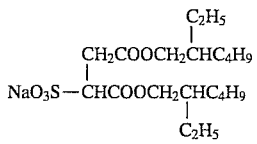

A process for the preparation of a dispersion of a dye trapping agent is described below.

To a mixture of 108 ml of a polymer latex (solid content: 13%) having the following structural formula, 20 g of a surface active agent having the following structural formula and 1,232 ml of water was added 600 ml of a 5% aqueous solution of an anionic surface active agent having the following structural formula with stirring in 10 minutes. The dispersion thus prepared was concentrated to 500 ml by means of an ultrafiltration module, and then desalted. To the dispersion was then added 1,500 ml of water. The same procedure was repeated to obtain 500 g of a dispersion of the dye trapping agent.

Polymer latex

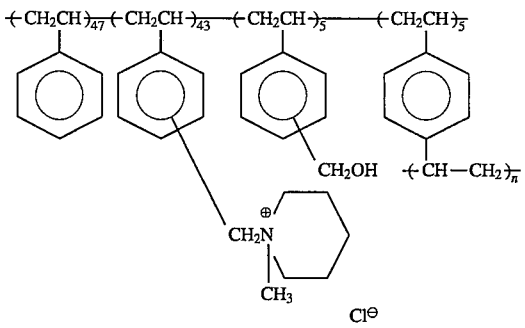

Surface active agent

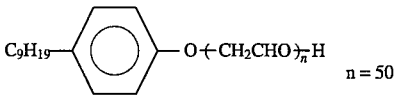

Anionic surface active agent

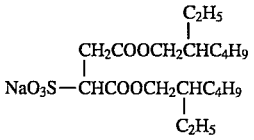

A process for the preparation of a gelatin dispersion of hydrophobic additive is described below.

Cyan, magenta and yellow dye-providing compounds and gelatin dispersions of electron donor were prepared in accordance with the formulations as set forth in Table 1. In some detail, various oil phase components were each dissolved at a temperature of about 60° C. to obtain a homogeneous solution. To the solution was then added an aqueous phase component which had been heated to a temperature of about 60° C. These components were mixed with stirring, and then subjected to dispersion by means of a homogenizer at 12,000 rpm for 13 minutes. To the dispersion was then added water. The mixture was then stirred to obtain a homogeneous dispersion.

TABLE 1

| | Cyan | Magenta | Yellow | Electron donor |
|---|---|---|---|---|
| Oil Phase | | | | |
| Dye-providing compound (1) | 9.05 g | — | — | — |
| Dye-providing compound (2) | 6.19 g | — | — | — |
| Dye-providing compound (3) | — | 15.5 g | — | — |
| Dye-providing compound (4) | — | — | 13.0 g | — |
| Electron donor (1) | 4.84 g | 5.61 g | 4.53 g | — |
| Electron donor (2) | — | — | — | 13.87 g |
| Inhibitor-releasing redox compound | — | — | — | 2.62 g |
| Electron transferring agent precursor | 1.42 g | 1.42 g | 0.86 g | — |
| Compound (1) | 0.42 g | 0.44 g | 0.40 g | — |
| Compound (2) | 1.53 g | 1.94 g | — | — |
| Compound (3) | 1.52 g | 1.94 g | — | — |
| High boiling solvent (1) | 1.91 g | 1.94 g | 5.20 g | — |
| High boiling solvent (2) | — | — | 3.90 ml | — |
| High boiling solvent (3) | 5.72 g | 5.81 g | — | 2.93 g |
| High boiling solvent (4) | — | — | — | 2.94 g |
| Surface active agent (2) | 1.55 g | 0.52 g | 1.50 g | 0.45 g |
| Methyl acetate | 34.5 ml | 34.5 ml | 25.0 ml | 18.0 ml |
| Methyl ethyl ketone | 47.5 ml | 47.5 ml | — | — |
| Aqueous Phase | | | | |
| Lime-treated gelatin | 10.0 g | 10.0 g | 10.0 g | 10.0 g |
| Citric acid | — | — | 0.14 g | 0.14 g |
| Sodium hydrogen-sulfite | — | — | — | 0.15 g |
| Water | 150 ml | 150 ml | 120 ml | 97 ml |
| Water | 150 ml | 160 ml | 115 ml | 61 ml |

Dye-providing compound (1)

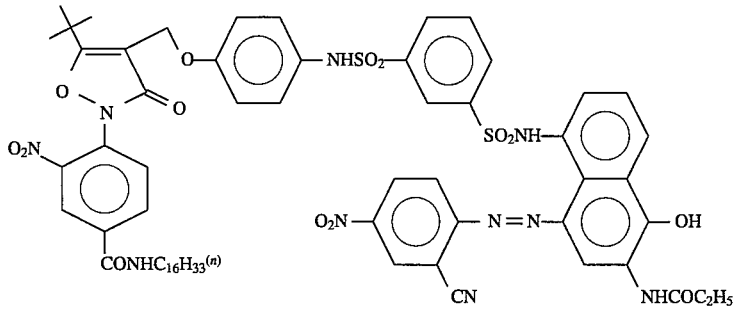

-continued
Dye-providing compound (2)
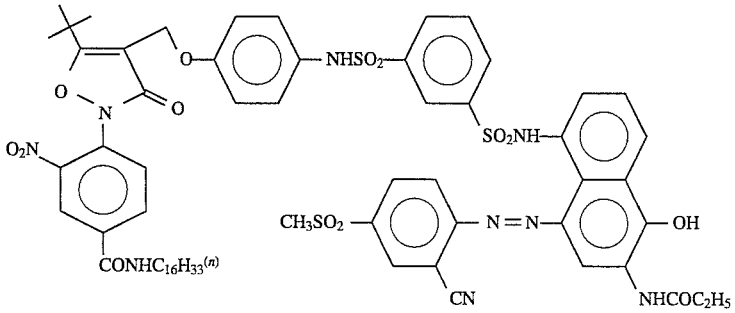
Dye-providing compound (3)
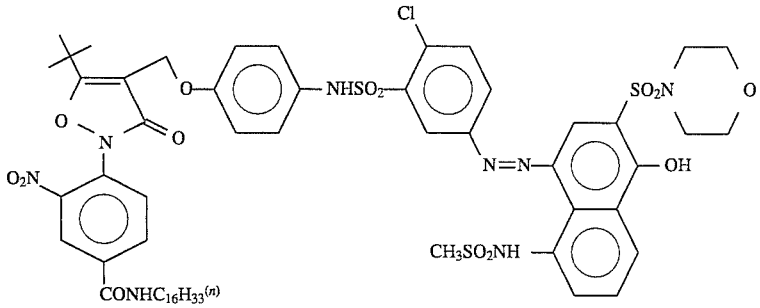
Dye-providing compound (4)
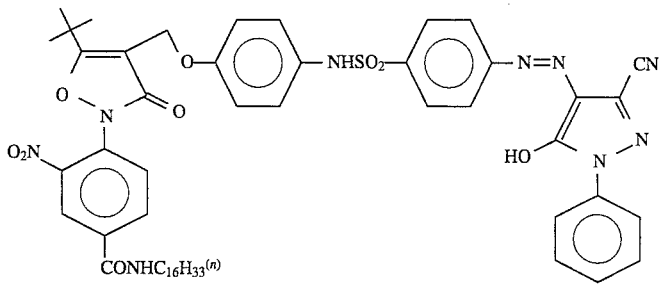
Electron donor (1)
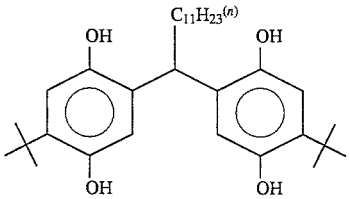
Electron donor (2)
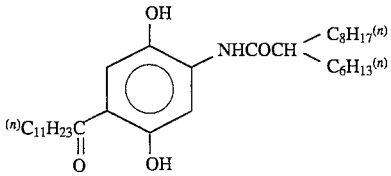

-continued
Inhibitor-releasing redox compound
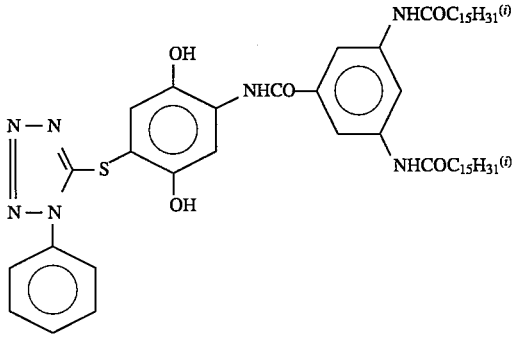
Electron transfer agent precursor
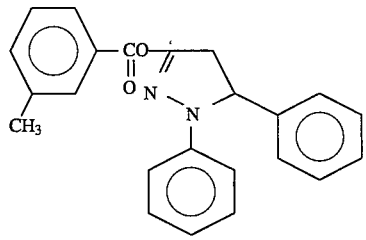
Compound (1)
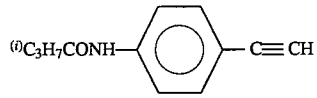
Compound (2)
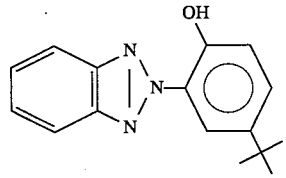
Compound (3)
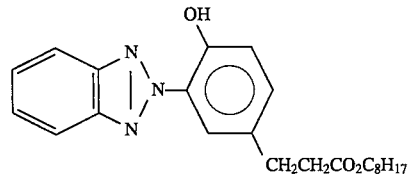
High boiling solvent (1)
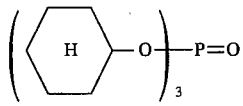
High boiling solvent (2)
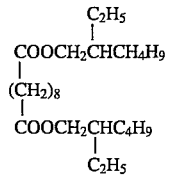

-continued

High boiling solvent (3)

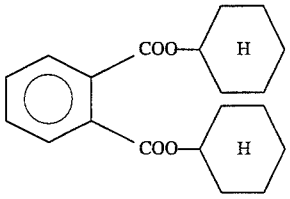

High boiling solvent (4)

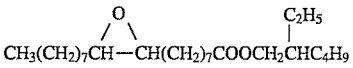

Surface active agent (2)

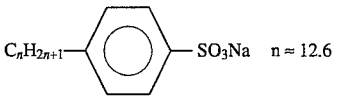

A process for the preparation of a light-sensitive silver halide emulsion is described below.

Light-Sensitive Silver Halide Emulsion (1) (for Red-Sensitive Emulsion Layer)

To an aqueous solution of gelatin (obtained by dissolving 20 g of gelatin, 0.5 g of potassium bromide, 3 g of sodium chloride and 30 mg of a chemical (A) having the following structural formula in 500 ml of water, and kept at a temperature of 45° C.) were added simultaneously Solution (I) and Solution (II) set forth in Table 2 at the same flow rate with vigorous stirring for 20 minutes. After 6 minutes, to the emulsion were then added simultaneously Solution (III) and Solution (IV) set forth in Table 2 at the same flow rate for 25 minutes. When 10 minutes passed after the beginning of the addition of Solution (III) and Solution (IV), an aqueous solution of a gelatin dispersion of dye (obtained by dissolving 1 g of gelatin, 70 mg of a dye (a) having the following structural formula, 139 mg of a dye (b) having the following structural formula and 5 mg of a dye (c) having the following structural formula in 105 ml of water, and kept at a temperature of 45° C.) was added to the emulsion in 20 minutes.

Chemical (A)

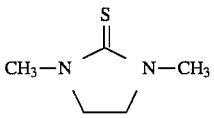

Dye (a)

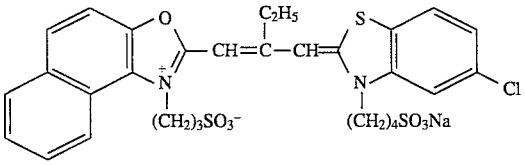

-continued

Dye (b)

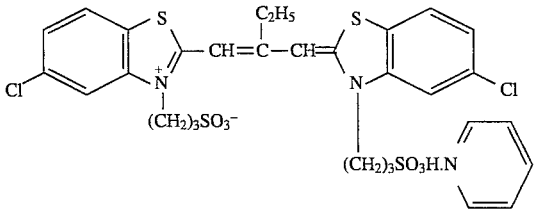

Dye (c)

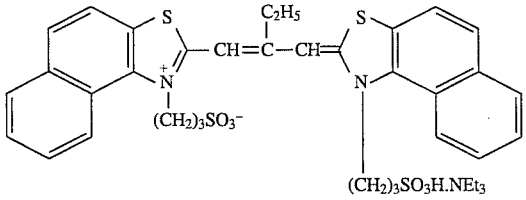

TABLE 2

| | Solution (I) | Solution (II) | Solution (III) | Solution (IV) |
|---|---|---|---|---|
| $AgNO_3$ | 50.0 g | — | 50.0 g | — |
| $NH_4NO_3$ | 0.19 g | — | 0.19 g | — |
| KBr | — | 28.0 g | — | 35.0 g |
| NaCl | — | 3.45 g | — | — |
| | Water to make 200 ml | Water to make 140 ml | Water to make 145 ml | Water to make 155 ml |

The emulsion was then rinsed and desalted by an ordinary method. To the emulsion was then added 22 g of lime-treated osein gelatin, and then the pH value and pAg value thereof were adjusted to 6.2 and 7.8, respectively. To the emulsion were added 4-hydroxy-6-methyl-1,3,3a,7-tetrazaindene, and then sodium thiosulfate and chloroauric acid. The emulsion was subjected to optimum chemical sensitization at a temperature of 68° C. To the emulsion was then added a fog inhibitor (2) having the following structural formula. The emulsion was then cooled to obtain 635 g of a monodisperse emulsion of cubic silver bromochloride grains having an average grain size of 0.30 μm.

Fog inhibitor (2)

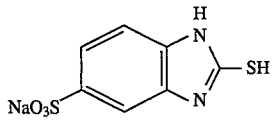

Light-Sensitive Silver Halide Emulsion (2) (for Red-Sensitive Emulsion Layer)

To an aqueous solution of gelatin (obtained by dissolving 20 g of gelatin, 0.5 g of potassium bromide, 6 g of sodium chloride and 30 mg of the foregoing chemical (A) in 800 ml of water, and kept at a temperature of 65° C.) were added simultaneously Solution (I) and Solution (II) set forth in Table 3 at the same flow rate for 30 minutes with vigorous stirring. After 5 minutes, to the emulsion were then added simultaneously Solution (III) and Solution (IV) set forth in Table 3 at the same flow rate for 15 minutes. When 2 minutes passed after the beginning of the addition of Solution (III) and Solution (IV), an aqueous solution of a gelatin dispersion of dye (obtained by dissolving 1.1 g of gelatin, 76 mg of the foregoing dye (a), 150 mg of the foregoing dye (b) and 5 mg of the foregoing dye (c) in 95 ml of water, and kept at a temperature of 50° C.) was added to the emulsion in 18 minutes.

TABLE 3

| | Solution (I) | Solution (II) | Solution (III) | Solution (IV) |
|---|---|---|---|---|
| $AgNO_3$ | 50.0 g | — | 50.0 g | — |
| $NH_4NO_3$ | 0.19 g | — | 0.19 g | — |
| KBr | — | 28.0 g | — | 35.0 g |
| NaCl | — | 3.45 g | — | — |
| | Water to make 200 ml | Water to make 140 ml | Water to make 145 ml | Water to make 155 ml |

The emulsion was then rinsed and desalted by an ordinary method. To the emulsion was then added 22 g of lime-treated osein gelatin, and then the pH value and pAg value thereof were adjusted to 6.2 and 7.8, respectively. To the emulsion were added 4-hydroxy-6-methyl-1,3,3a,7-tetrazaindene, and then sodium thiosulfate and chloroauric acid. The emulsion was subjected to optimum chemical sensitization at a temperature of 68° C. To the emulsion was then added a fog inhibitor (1) having the following structural formula. The emulsion was then cooled to obtain 635 g of a monodisperse emulsion of cubic silver bromochloride grains having an average grain size of 0.50 μm.

Fog inhibitor (1)

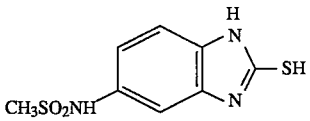

Light-Sensitive Silver Halide Emulsion (3) (for Green-Sensitive Emulsion Layer).

To an aqueous solution of gelatin (obtained by dissolving 20 g of gelatin, 0.5 g of potassium bromide, 4 g of sodium chloride and 15 mg of the foregoing chemical (A) in 690 ml of water, and kept at a temperature of 47° C.) were added simultaneously Solution (I) and Solution (II) set forth in Table 4 at the same flow rate for 8 minutes with vigorous stirring. After 10 minutes, to the emulsion were then added simultaneously Solution (III) and Solution (IV) set forth in Table 4 at the same flow rate for 32 minutes. When 1 minute passed after the completion of the addition of Solution (III) and Solution (IV), an aqueous solution of a gelatin dispersion of dye (obtained by dissolving 2.5 g of gelatin, and 250 mg of a dye (d) having the following structural formula in 100 ml of water, and kept at a temperature of 45° C.) was added to the emulsion collectively.

Dye (d)

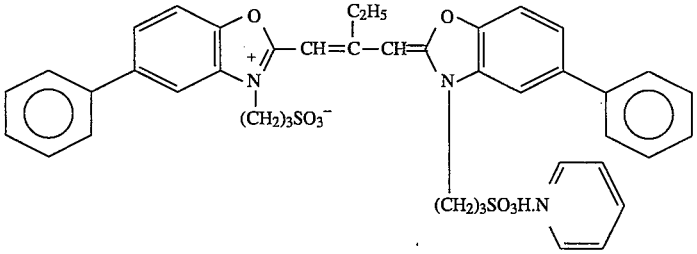

TABLE 4

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.13 g | — | 0.38 g | — |
| KBr | — | 9.8 g | — | 44.8 g |
| NaCl | — | 2.06 g | — | 5.51 g |
| | Water to make 110 ml | Water to make 110 ml | Water to make 245 ml | Water to make 245 ml |

The emulsion was then rinsed and desalted by an ordinary method. To the emulsion was then added 20 g of lime-treated osein gelatin, and then the pH value and pAg value thereof were adjusted to 6.0 and 7.6, respectively. To the emulsion were added 4-hydroxy-6-methyl-1,3,3a,7-tetrazaindene, and then sodium thiosulfate. The emulsion was subjected to optimum chemical sensitization at a temperature of 68° C. To the emulsion was then added the foregoing fog inhibitor (1). The emulsion was then cooled to obtain 635 g of a monodisperse emulsion of cubic silver bromochloride grains having an average grain size of 0.27 μm.

Light-Sensitive Silver Halide Emulsion (4) (for Green-Sensitive Emulsion Layer)

To an aqueous solution of gelatin (obtained by dissolving 20 g of gelatin, 0.3 g of potassium bromide, 6 g of sodium chloride and 15 mg of the foregoing chemical (A) in 700 ml of water, and kept at a temperature of 60° C.) were added simultaneously Solution (I) and Solution (II) set forth in Table 5 at the same flow rate for 20 minutes with vigorous stirring. After 10 minutes, to the emulsion were then added simultaneously Solution (III) and Solution (IV) set forth in Table 5 at the same flow rate for 20 minutes. When 1 minute passed after the completing of the addition of Solution (III) and Solution (IV), an aqueous solution of a gelatin dispersion of dye (obtained by dissolving 1.8 g of gelatin, and 180 mg of the foregoing dye (d) in 75 ml of water, and kept at a temperature of 45° C.) was added to the emulsion collectively.

TABLE 5

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.19 g | — | 0.38 g | — |
| KBr | — | 9.8 g | — | 44.8 g |
| NaCl | — | 2.06 g | — | 5.51 g |
| | Water to make 165 ml | Water to make 165 ml | Water to make 205 ml | Water to make 205 ml |

The emulsion was then rinsed and desalted by an ordinary method. To the emulsion was then added 20 g of lime-treated osein gelatin, and then the pH value and pAg value thereof were adjusted to 6.0 and 7.6, respectively. To the emulsion were added 4-hydroxy-6-methyl-1,3,3a,7-tetrazaindene, and then sodium thiosulfate. The emulsion was subjected to optimum chemical sensitization at a temperature of 68° C. To the emulsion was then added the foregoing fog inhibitor (1). The emulsion was then cooled to obtain 635 g of a monodisperse emulsion of cubic silver bromochloride grains having an average grain size of 0.45 μm.

Light-Sensitive Silver Halide Emulsion (5) (for Blue-Sensitive Emulsion Layer)

To an aqueous solution of gelatin (obtained by dissolving 20 g of gelatin, 0.5 g of potassium bromide, 4 g of sodium chloride and 15 mg of the foregoing chemical (A) in 690 ml of water, and kept at a temperature of 52° C.) were added simultaneously Solution (I) and Solution (II) set forth in Table 6 at the same flow rate for 8 minutes with vigorous stirring. After 10 minutes, to the emulsion were then added simultaneously Solution (III) and Solution (IV) set forth in Table 6 at the same flow rate for 32 minutes. When 1 minute passed after the completion of the addition of Solution (III) and Solution (IV), an aqueous solution of a dye (obtained by dissolving 235 mg of a dye (e) having the following structural formula, and 120 mg of a dye (f) having the following structural formula in a mixture of 95 ml of water and 5 ml of methanol, and kept at a temperature of 45° C.) was added to the emulsion collectively.

Dye (e)

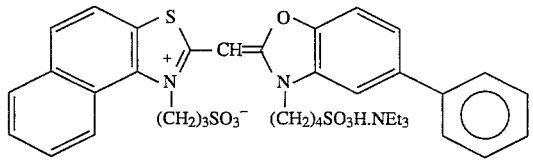

Dye (f)

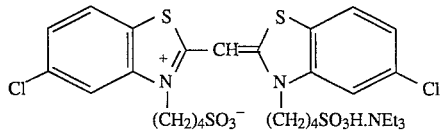

TABLE 6

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.13 g | — | 0.38 g | — |
| KBr | — | 9.8 g | — | 44.8 g |
| NaCl | — | 2.06 g | — | 5.52 g |
| $K_2IrCl_4$ | — | 0.03 mg | — | — |
| | Water to make 110 ml | Water to make 110 ml | Water to make 240 ml | Water to make 240 ml |

The emulsion was then rinsed and desalted by an ordinary method. To the emulsion was then added 22 g of lime-treated osein gelatin, and then the pH value and pAg value thereof were adjusted to 6.0 and 7.7, respectively. To the emulsion were added 4-hydroxy-6-methyl-1,3,3a,7-tetrazaindene, and then sodium thiosulfate. The emulsion was subjected to optimum chemical sensitization at a temperature of 68° C. To the emulsion was then added the foregoing fog inhibitor (1). The emulsion was then cooled to obtain 635 g of a monodisperse emulsion of cubic silver.bromochloride grains having an average grain size of 0.30 μm.

Light-Sensitive Silver Halide Emulsion (6) (for Blue-Sensitive Emulsion Layer)

To an aqueous solution of gelatin (obtained by dissolving 20 g of gelatin, 0.3 g of potassium bromide, 9 g of sodium chloride and 15 mg of the foregoing chemical (A) in 695 ml of water, and kept at a temperature of 65° C.) were added simultaneously solution (I) and Solution (II) set forth in Table 7 at the same flow rate for 10 minutes with vigorous stirring. After 10 minutes, to the emulsion were then added simultaneously Solution (III) and Solution (IV) set forth in Table 7 at the same flow rate for 30 minutes. When 1 minute passed after the completion of the addition of Solution (III) and Solution (IV), an aqueous solution of a dye (obtained by dissolving 155 mg of the foregoing dye (e) and 78 mg of the foregoing dye (f) in a mixture of 66 ml of water and 4 ml of methanol, and kept at a temperature of 60° C.) was added to the emulsion collectively.

TABLE 7

| | Solution (I) | Solution (II) | Solution (III) | Solution (IV) |
|---|---|---|---|---|
| $AgNO_3$ | 25.0 g | — | 75.0 g | — |
| $NH_4NO_3$ | 0.13 g | — | 0.37 g | — |
| KBr | — | 12.3 g | — | 42.0 g |
| NaCl | — | 2.58 g | — | 5.18 g |
| $K_2IrCl_4$ | — | 0.02 mg | — | — |
| | Water to make 120 ml | Water to make 120 ml | Water to make 225 ml | Water to make 225 ml |

The emulsion was then rinsed and desalted by an ordinary method. To the emulsion was then added 22 g of lime-treated osein gelatin, and then the pH value and pAg value thereof were adjusted to 6.0 and 7.7, respectively. To the emulsion were added 4-hydroxy-6-methyl-1,3,3a,7-tetrazaindene, and then sodium thiosulfate. The emulsion was subjected to optimum chemical sensitization at a temperature of 68° C. To the emulsion was then added the foregoing fog inhibitor (1). The emulsion was then cooled to obtain 635 g of a monodisperse emulsion of cubic silver bromochloride grains having an average grain size of 0.52 μm.

The foregoing materials were used to prepare a photographic light-sensitive material Specimen 101 as set forth in Table 8.

TABLE 8

(constitution of photographic light-sensitive material Specimen 101)

| Layer No. | Layer name | Additive | Coated amount ($mg/m^2$) |
|---|---|---|---|
| 7th layer | Protective layer II | Acid-treated gelatin | 340 |
| | | PMMA (Polymethylmethacrylate) latex (size: 3 μm) | 20 |
| | | Colloidal silver | 0.7 |
| | | Surface active agent (3) | 8 |
| | | Fluorinic surface active agent (6) | 2 |
| | | Calcium nitrate | 4 |
| 6th layer | Protective layer I | Lime-treated gelatin | 410 |
| | | Zinc hydroxide | 440 |
| | | Electron donor (2) | 75 |
| | | Inhibitor-releasing redox compound (1) | 14 |
| | | High boiling solvent (3) | 16 |

TABLE 8-continued

| | | | |
|---|---|---|---|
| | | High boiling solvent (4) | 16 |
| | | Surface active agent (3) | 4 |
| | | Dextran | 16 |
| | | Water-soluble polymer (1) | 1.4 |
| | | Polymer latex (1) | 66 |
| | | Surface active agent (4) | 28 |
| | | Surface active agent (2) | 4.5 |
| 5th layer | Blue-sensitive emulsion layer | Light-sensitive silver halide emulsion (5) | 315 (calculated as silver) |
| | | Light-sensitive silver halide emulsion (6) | 95 (calculated as silver) |
| | | Dye-providing compound (4) | 380 |
| | | Lime-treated gelatin | 520 |
| | | Electron donor (1) | 132 |
| | | Electron transfer agent precursor | 25 |
| | | Compound (1) | 11.7 |
| | | High boiling solvent (1) | 152 |
| | | High boiling solvent (2) | 114 |
| | | Surface active agent (2) | 44 |
| | | Fog inhibitor (1) | 0.9 |
| | | Water-soluble polymer (1) | 11 |
| 4th layer | Interlayer | Lime-treated gelatin | 550 |
| | | Electron donor (2) | 159 |
| | | Inhibitor-releasing redox compound (1) | 30 |
| | | High boiling solvent (3) | 34 |
| | | High boiling solvent (4) | 34 |
| | | Surface active agent (2) | 5.1 |
| | | Polymer latex (1) | 88 |
| | | Electron transfer agent | 78 |
| | | Dextran | 38 |
| | | Hardener (1) | 36 |
| | | Surface active agent (4) | 26 |
| | | Water-soluble polymer (1) | 10 |
| 3rd layer | Green-sensitive emulsion layer | Light-sensitive silver halide emulsion (3) | 250 (calculated as silver) |
| | | Light-sensitive silver halide emulsion (4) | 100 (calculated as silver) |
| | | Dye-providing compound (3) | 359 |
| | | Lime-treated gelatin | 430 |
| | | Electron donor (1) | 130 |
| | | Electron transfer agent precursor | 33 |
| | | Compound (1) | 10 |
| | | Compound (2) | 45 |
| | | Compound (3) | 45 |
| | | High boiling solvent (1) | 45 |
| | | High boiling solvent (3) | 135 |
| | | Fog inhibitor (1) | 0.8 |
| | | Water-soluble polymer (1) | 13 |
| | | Surface active agent (2) | 8 |
| 2nd layer | Interlayer | Lime-treated gelatin | 760 |
| | | Zinc hydroxide | 800 |
| | | Electron donor (2) | 139 |
| | | Inhibitor-releasing redox compound (1) | 26 |
| | | High boiling solvent (3) | 29 |
| | | High boiling solvent (4) | 29 |
| | | Surface active agent (2) | 4.5 |
| | | Surface active agent (3) | 5 |
| | | Dextran | 29 |
| | | Water-soluble polymer (1) | 3.0 |
| | | Polymer latex (1) | 122 |
| | | Surface active agent (4) | 54 |
| 1st layer | Red-sensitive emulsion layer | Light-sensitive silver halide emulsion (1) | 108 (calculated as silver) |
| | | Light-sensitive silver halide emulsion (2) | 60 (calculated as silver) |
| | | Dye-providing compound | 185 |

TABLE 8-continued

| | |
|---|---|
| (1) | |
| Dye-providing compound (2) | 127 |
| Lime-treated gelatin | 580 |
| Electron donor (1) | 100 |
| Electron transfer agent precursor | 29 |
| Compound (1) | 8.2 |
| Compound (2) | 31 |
| Compound (3) | 31 |
| High boiling solvent (1) | 39 |
| High boiling solvent (3) | 117 |
| Surface active agent (3) | 21 |
| Fog inhibitor (1) | 0.2 |
| Fog inhibitor (2) | 0.3 |
| Water-soluble polymer (1) | 7 |
| Surface active agent (2) | 21 |

Support (1) Paper support laminated with polyethylene (thickness: 131 μm)

Support 1

| Layer name | Composition | Layer thickness (μm) |
|---|---|---|
| Surface undercoating layer | Gelatin | 0.1 |
| Surface PE (polyethylene) layer (glossy) | Low density polyethylene density: 0.923): 89.2 parts by weight Surface-treated titanium by weight oxide: 10.0 parts | 36.0 |
| Pulp layer | High quality paper (LBKP/NBKP = 1/1; density: 1.080) | 64.0 |
| Back PE layer (mat) | High density polyethylene (density: 0.960) | 31.0 |
| Back undercoating layer | Gelatin containing colloidal silica | 0.05 |
| | | 131.15 |

Surface active agent (3)

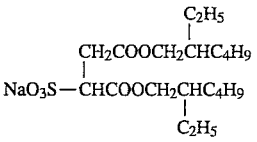

Surface active agent (4)

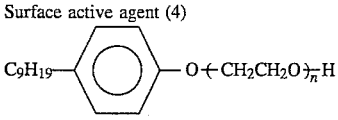

n = 50

Surface active agent (6)

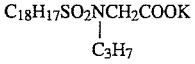

Water-soluble polymer (1)

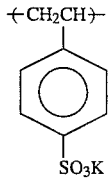

Hardener (1)

$CH_2{=}CHSO_2CH_2CH_2SO_2CH{=}CH_2$

Polymer latex (1)

TABLE 8-continued

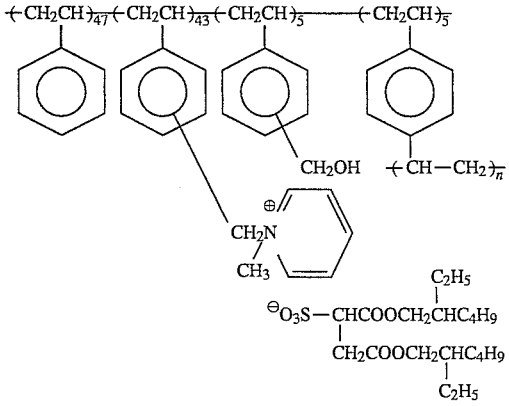

Electron transfer agent

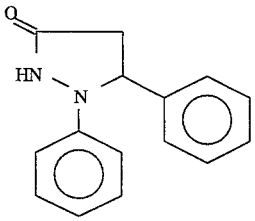

A process for the preparation of a dispersion of organic solid pigment is described below.

20 g of a pigment (27) according to the present invention and 0.9 g of the foregoing surface active agent (3) as a dispersant were added to 180 ml of a 2.1% aqueous solution of gelatin. The mixture was then ground with glass beads having an average grain diameter of 0.75 mm by means of a mill for 30 minutes. The glass beads were then removed from the mixture to obtain a dispersion of pigment having an average grain diameter of 0.07 μm.

Dispersions of other pigments according to the present invention were prepared in the same manner as above.

Specimens 102 to 108 having compositions same to that of Specimen 101 were prepared in the same manner as Specimen 101, except that pigments according to the present invention as set forth in Table 9 were incorporated in the 4th layer and/or 2nd layer.

Further, Specimen 109 was prepared in the same manner as Specimen 101 except that colloidal silver grains having an average grain diameter of 0.02 μm were incorporated in the 4th layer in an amount of 150 mg/m$^2$. Likewise, Specimen 110 was prepared in the same manner as Specimen 101 except that Exemplary Compound (35) as disclosed in JP-B-1-46057 was incorporated in the 4th layer in an amount of 300 mg/m$^2$.

Compound (35)

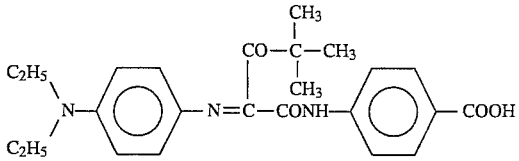

TABLE 9

| Light-sensitive material | 4th layer Pigment | 4th layer Coated amount (mg/m²) | 2nd layer Pigment | 2nd layer Coated amount (mg/m²) |
|---|---|---|---|---|
| 101 | — | — | — | — |
| 102 | (27) | 300 | — | — |
| 103 | (27) | 200 | (27) | 100 |
| 104 | (3) | 300 | — | — |
| 105 | (12) | 150 | (12) | 150 |
| 106 | (18) | 250 | — | — |
| 107 | (23) | 200 | — | — |
| 108 | (33) | 300 | — | — |
| 109 | * | 150 | — | — |
| 110 | ** | 300 | — | — |

(Note: Specimens 101, 109 and 110 are comparative while the others are according to the present invention)
*Colloidal silver (average grain diameter: 0.02 μm)
**Exemplary Compound (35) disclosed in JP-B-l-46057

A process for the preparation of an image-receiving material is described below.

An image-receiving material R101 having the constitution as set forth in Table 10 was prepared.

TABLE 10

(constitution of image-receiving material R101)

| Layer No. | Additive | Coated amount (mg/m²) |
|---|---|---|
| 4th layer | Water-soluble polymer (3) | 240 |
| | Water-soluble polymer (4) | 60 |
| | Potassium nitrate | 50 |
| | Surface active agent (3) | 7 |
| | Surface active agent (6) | 5 |
| 3rd layer | Gelatin | 250 |
| | Water-soluble polymer (3) | 10 |
| | Surface active agent (7) | 27 |
| | Hardener (2) | 170 |
| 2nd layer | Gelatin | 800 |
| | Water-soluble polymer (3) | 100 |
| | Water-soluble polymer (5) | 660 |
| | Polymer dispersion | 1,190 |
| | High boiling solvent (5) | 650 |
| | Fluorescent brightening agent | 22 |
| | Mordant | 2,350 |
| | Surface active agent (3) | 10 |
| | Guanidine picolate | 2,900 |
| | Stain inhibitor | 32 |
| 1st layer | Gelatin | 150 |
| | Water-soluble polymer (3) | 40 |
| | Surface active agent (3) | 6 |
| | Surface active agent (7) | 27 |
| | Hardener (2) | 170 |

Support (2) Paper support laminated with polyethylene (thickness: 206 μm)

Support (2)

| Layer name | Composition | Layer thickness (μm) |
|---|---|---|
| Surface undercoating layer | Gelatin | 0.1 |
| Surface PE layer (glossy) | Low density polyethylene (density: 0.923): 89.2 parts by weight Surface-treated titanium oxide: 10.0 parts by weight Ultramarine: 0.8 parts by weight | 35.0 |
| Pulp layer | Quality paper (LBKP/NBKP = 1/1; density: 1.080) | 140.8 |
| Back PE layer (mat) | High density polyethylene (density: 0.960) | 30.0 |
| Back undercoating layer | Gelatin (containing colloidal silica) | 0.05 |
| | | 205.95 |

Water-soluble polymer (3):
Sumikagel L5-H (available from Sumitomo Chemical Co., Ltd.)
Water-soluble polymer (4):
Copper Carageenan (available from Taito Co., Ltd.)
Water-soluble polymer (5):
Dextran (molecular weight: 70,000)
Polymer dispersion:
Nipol LX814 (available from Nihon Zeon Co., Ltd.)
Surface active agent (6)

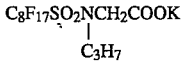

Surface active agent (7)

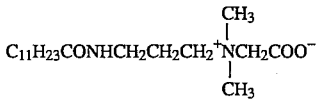

High boiling solvent (5)
$C_{26}H_{46.9}Cl_{7.1}$ (Emapara 40, chlorinated paraffin; available from Ajinomoto Co, Inc.)
Fluorescent brightening agent

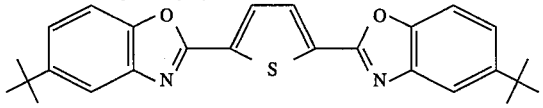

Stain inhibitor

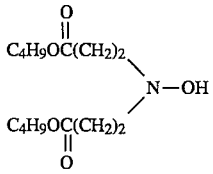

Mordant

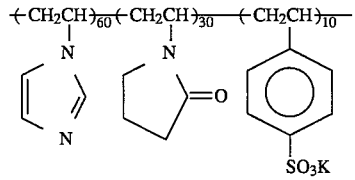

Hardener (2)

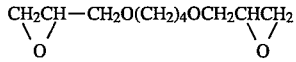

The foregoing photographic light-sensitive material Specimens 101 to 110 and the foregoing image-receiving material R101 were processed by means of Pictrostat 200 available from Fuji Photo Film Co., Ltd.

In some detail, the photographic light-sensitive material specimens were each subjected to scanning exposure to an original (test chart in which yellow, magenta, cyan and gray wedges having a continuous density change had been recorded) through a slit. The photographic light-sensitive material specimens thus exposed .were each dipped in water kept at a temperature of 40° C. for 2.5 seconds, squeezed between rollers, and then immediately laminated on the image-receiving material in such an arrangement that the coating layers those of were brought into contact with each other. The laminate was then heated for 17 seconds over a heat drum which had been adjusted so that the temperature of the water-absorbed emulsion surface thereof reached 80° C. Subsequently, the photographic light-sensitive material was peeled off the image-receiving material. As a result, a sharp color image corresponding to the original was formed on the image-receiving material.

Another batch of the foregoing photographic light-sensitive material specimens were similarly subjected to exposure and processing with the gray density of 0.7 on the original being properly adjusted to the same value on the specimens using Fuji CC Filter available from Fuji Photo Film Co., Ltd. The yellow, magenta and cyan densities of the image area corresponding to the magenta density of 1.2 on the original were determined to evaluate the color reproducibility. The density measurement was carried out by measuring the reflective density by means of X Lite 404 available from The X Lite Co., Ltd.

The results are set forth in Table 11.

TABLE 11

| Specimen No. of Photographic light-sensitive material | Dmin | | | Dmax | | | M density of 1.2 on original | | |
|---|---|---|---|---|---|---|---|---|---|
| | Cy | M | Y | Cy | M | Y | Cy | M | Y |
| 101 | 0.09 | 0.13 | 0.11 | 2.45 | 2.40 | 2.25 | 0.12 | 0.92 | 0.31 |
| 102 | 0.08 | 0.13 | 0.11 | 2.48 | 2.42 | 2.25 | 0.13 | 1.22 | 0.33 |
| 103 | 0.08 | 0.12 | 0.11 | 2.44 | 2.40 | 2.20 | 0.13 | 1.20 | 0.33 |
| 104 | 0.09 | 0.14 | 0.13 | 2.49 | 2.44 | 2.26 | 0.13 | 1.21 | 0.33 |
| 105 | 0.08 | 0.13 | 0.12 | 2.45 | 2.41 | 2.21 | 0.13 | 1.18 | 0.32 |
| 106 | 0.08 | 0.12 | 0.11 | 2.44 | 2.43 | 2.24 | 0.13 | 1.18 | 0.32 |
| 107 | 0.09 | 0.13 | 0.12 | 2.48 | 2.45 | 2.24 | 0.13 | 1.21 | 0.33 |
| 108 | 0.08 | 0.12 | 0.11 | 2.46 | 2.40 | 2.20 | 0.12 | 1.10 | 0.31 |
| 109 | 0.08 | 0.12 | 0.10 | 2.35 | 1.80 | 1.43 | 0.10 | 0.50 | 0.20 |
| 110 | 0.09 | 0.16 | 0.53 | 2.48 | 2.45 | 2.45 | 0.12 | 1.24 | 0.70 |

It can be seen in Table 11 that the photographic light-sensitive material Specimen 101 exhibits a low magenta image density with respect to the magenta density on the original, thus showing a significant color loss and hence a poor color reproducibility. The photographic light-sensitive material Specimen 109 exhibits a low maximum density (Dmax). The photographic light-sensitive material Specimen 110 exhibits a high minimum density (Dmin). Thus, all these comparative specimens provide an insufficient image. On the other hand, the photographic light-sensitive material Specimens 102 to 108, comprising an organic solid pigment according to the present invention, exhibit an increased magenta density without increasing yellow and cyan stains. Further, these specimens can stand comparison with Specimen 101 in respect to Dmax and Dmin. This demonstrates that the photographic light-sensitive materials according to the present invention exhibit an excellent color reproducibility.

EXAMPLE 2

A photographic light-sensitive material Specimen 201 having the same composition as the photographic light-sensitive material Specimen 101 was prepared in the same manner except that Pigment (18) according to the present invention was incorporated in the 3rd layer in an amount of 250 mg/m$^2$.

The photographic light-sensitive material Specimen 201 and the image-receiving material R101 were processed, and then measured for density in the same manner as in Example 1. As a result, it was found that Specimen 201 exhibits a drastically improved color reproducibility similarly to Specimen 106. It was also found that the pigment according to the present invention can exert an excellent effect when incorporated in the interlayer as well as when incorporated in the light-sensitive silver halide emulsion layer.

EXAMPLE 3

Light-Sensitive Silver Halide Emulsion (7) (for Red-Sensitive Emulsion Layer))

To an aqueous solution of gelatin (obtained by dissolving 20 g of gelatin, 0.3 g of potassium bromide, 2 g of sodium chloride and 30 mg of Compound (a) having the following structural formula in 600 ml of water, and kept at a temperature of 45° C.) were added simultaneously Solution (I) and Solution (II) set forth in Table 12 at the same flow rate for 20 minutes with vigorous stirring. After 5 minutes, to the mixture were then added simultaneously Solution (III) and Solution (IV) set forth in Table 12 at the same flow rate for 25 minutes.

Compound (a)

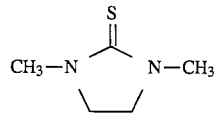

TABLE 12

| | Solution (I) | Solution (II) | Solution (III) | Solution (IV) |
|---|---|---|---|---|
| $AgNO_3$ | 30.0 g | — | 70.0 g | — |
| $NH_4NO_3$ | 0.12 g | — | 0.27 g | — |
| KBr | — | 13.7 g | — | 44.0 g |
| NaCl | — | 3.6 g | — | 2.4 g |
| $K_2IrCl_4$ | — | — | — | 0.04 mg |
| | Water to make 150 ml | Water to make 150 ml | Water to make 350 ml | Water to make 350 ml |

The emulsion was then rinsed and desalted by an ordinary method. To the emulsion were then added 22 g of lime-treated osein gelatin and 90 mg of a Compound (b) having the following structural formula, and the pH value and pAg value thereof were adjusted to 6.2 and 7.7, respectively. To the emulsion were added 500 mg of a decomposition product of ribonucleic acid and 2 mg of trimethylthiourea. The emulsion was subjected to optimum chemical sensitization at a temperature of 60° C. for 50 minutes. To the emulsion were then sequentially added 225 mg of 4-hydroxy-6-methyl-1,3,3a,7-tetrazaindene, 64 mg of a Dye (a) having the following structural formula and 500 mg of KBr. The emulsion was then cooled to obtain 635 g of a monodisperse emulsion of cubic silver bromochloride grains having an average grain size of 0.30 μm.

Compound (b)

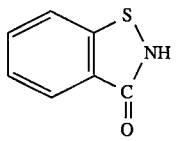

Dye (a)

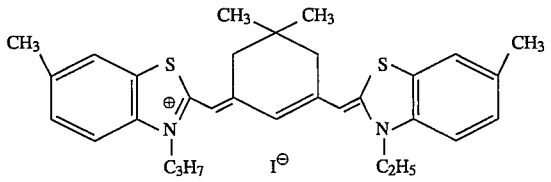

Light-Sensitive Silver Halide Emulsion (8) (for Green-Sensitive Emulsion Layer)

To an aqueous solution of gelatin (obtained by dissolving 20 g of gelatin, 0.3 g of potassium bromide, 6 g of sodium chloride and 15 mg of the foregoing Compound (a) in 700 ml of water, and kept at a temperature of 55° C.) were added simultaneously Solution (I) and Solution (II) set forth in Table 13 at the same flow rate for 20 minutes with vigorous stirring. After 10 minutes, to the mixture were then added simultaneously Solution (III) and Solution (IV) set forth in Table 13 at the same flow rate for 20 minutes. When 1 minute passed after the completion of the addition of Solution (III) and Solution (IV), an aqueous solution of a dye (obtained by dissolving 1.8 g of gelatin and 180 mg of Dye (b) in 95 ml of water, and kept at a temperature of 45° C.) was added to the emulsion collectively.

Dye (b)

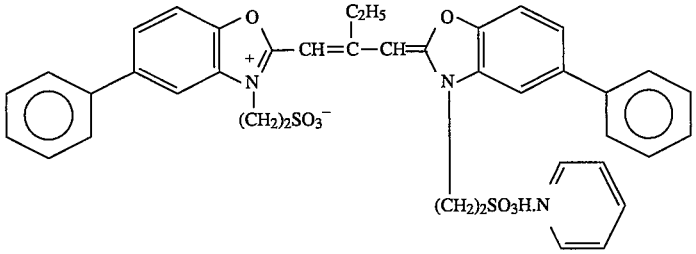

TABLE 13

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.19 g | — | 0.38 g | — |
| KBr | — | 9.80 g | — | 44.8 g |
| NaCl | — | 2.06 g | — | 5.51 g |
| | Water to make 165 ml | Water to make 165 ml | Water to make 205 ml | Water to make 205 ml |

The emulsion was then rinsed and desalted by an ordinary method. To the emulsion was then added 20 g of lime-treated osein gelatin so that the pH value and pAg value thereof were adjusted to 6.0 and 7.6, respectively. To the emulsion were 1 mg of sodium thiosulfate, 47 mg of 4-hydroxy-6-methyl-1,3,3a,7-tetrazaindene, and 0.6 mg of chloroauric acid. The emulsion was subjected to optimum chemical sensitization at a temperature of 68° C. To the emulsion was then added 165 mg of Fog inhibitor (2). The emulsion was then cooled to obtain 635 g of a monodisperse emulsion of cubic silver bromochloride grains having an average grain size of 0.45 μm.

Fog inhibitor (2)

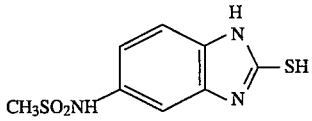

Light-Sensitive Silver Halide Emulsion (9) (for Blue-Sensitive Emulsion Layer)

To an aqueous solution of gelatin (obtained by dissolving 20 g of gelatin, 0.3 g of potassium bromide, 2 g of sodium chloride and 15 mg of the foregoing Compound (a) in 630 ml of water, and kept at a temperature of 75° C.) was added Solution (I) set forth in Table 14 in 30 minutes. After 30 seconds, Solution (II) was added to the mixture in 30 minutes. When 5 minutes passed after the completion of the addition of Solution (II), Solution (III) was added to the emulsion in 30 minutes. After 30 seconds, Solution (IV) was added to the emulsion in 30 minutes. Thereafter, Solution (III) and Solution (IV) set forth in Table 14 were added to the emulsion in 35 minutes. The emulsion was then neutralized with 19 ml of a 1N solution of sodium hydroxide to make pH 6. To the emulsion was then added 1.4 mg of sodium thiosulfate. After 3 minutes, 1.2 mg of chloroauric acid was added to the emulsion. The emulsion was then kept at a temperature of 75° C. for 60 minutes. To the emulsion was then added a solution of 430 mg of a Dye (c) having the following structural formula in 80 ml of methanol. After 5 minutes, the emulsion was cooled to a temperature of 35° C.

Dye (c)

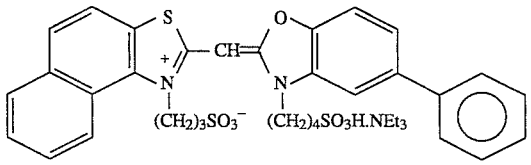

TABLE 14

| | Solution (I) | Solution (II) | Solution (III) | Solution (IV) | Solution (V) |
|---|---|---|---|---|---|
| $AgNO_3$ | 37.4 g | — | 74.9 g | — | — |
| $NH_4NO_3$ | 0.13 g | — | 0.37 g | — | — |
| KBr | — | 24.6 g | — | 4.92 g | — |
| KI | — | — | — | — | 2.0 g |
| | Water to make 200 ml | Water to make 200 ml | Water to make 400 ml | Water to make 400 ml | Water to make 190 ml |

Thereafter, Solution V was added to the emulsion in 5 minutes. The emulsion was then rinsed and desalted by an ordinary method. To the emulsion were then added 6 g of lime-treated osein gelatin and 68 mg of Fog inhibitor (1), and pH was adjusted to 6.0. The pAg value and electrical conductivity of the emulsion were 8.5 and 4,000 μS, respectively. The emulsion grains thus obtained comprised octahedral silver halide grains having a grain size of 0.4 μm.

Fog inhibitor (1)

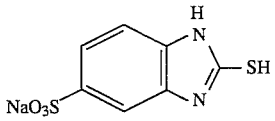

A dispersion of zinc hydroxide was prepared in the same manner as in Example 1.

A process for the preparation of gelatin dispersions of dye-providing compound is described below.

7.3 g of Cyan dye-providing compound (A1) having the following structural formula, 10.6 g of Cyan dye-providing compound (A2), 0.8 g of Surface active agent (1) having the following structural formula, 7 g of High boiling organic solvent (1) having the following structural formula, 3 g of High boiling organic solvent (2) having the following structural formula, and 0.23 g of Fog inhibitor (3) having the following structural formula were measured out. These materials were mixed with 50 ml of ethyl acetate and dissolved at a temperature of about 60° C. to make a homogeneous solution. The solution thus obtained was then mixed with 71 g of a 14% aqueous solution of lime-treated gelatin and 80 ml of water with stirring. The mixture was then subjected to dispersion at 10,000 rpm for 10 minutes by means of a homogenizer. After dispersion, to the dispersion was added 180 ml of water for dilution. Thus, a dispersion of cyan dye-providing compound was obtained.

Cyan dye-providing compound (A1)

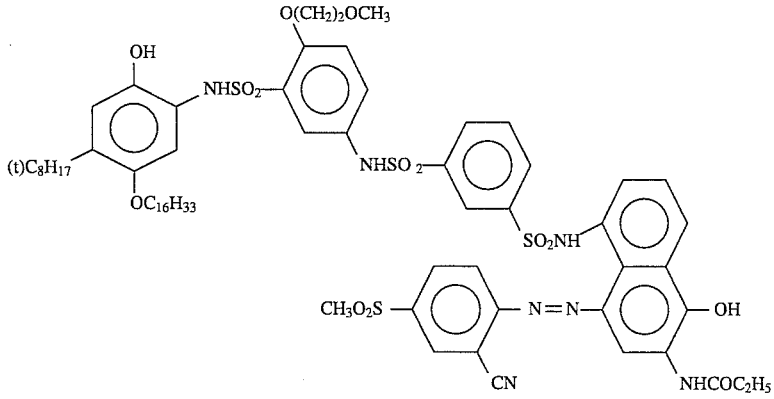

-continued

Cyan dye-providing compound (A2)

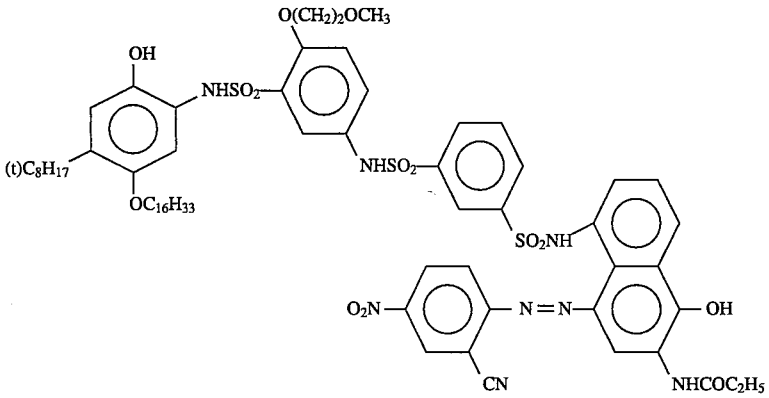

Fog inhibitor (3)

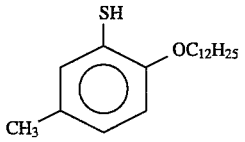

High boiling solvent (1)

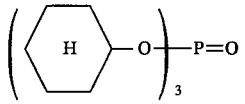

High boiling solvent (2)

$(C_8H_{17}O)_3-P=O$

Surface active agent (1)

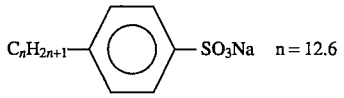

14.93 g of Magenta dye-providing compound (B) having the following structural formula, 0.384 g of the foregoing Surface active agent (1), 7.4 g of the foregoing High boiling organic solvent (1), and 0.20 g of the foregoing Fog inhibitor (3) were measured out. These materials were mixed with 50 ml of ethyl acetate and dissolved at a temperature of about 60° C. to make a homogeneous solution. The solution thus obtained was then mixed with 71 g of a 14% aqueous solution of lime-treated gelatin and 100 ml of water with stirring. The mixture was then subjected to dispersion at 10,000 rpm for 10 minutes by means of a homogenizer. Thereafter, to the dispersion was added 120 ml of water for dilution. Thus, a dispersion of magenta dye-providing compound was obtained.

Magneta dye-providing compound (B)

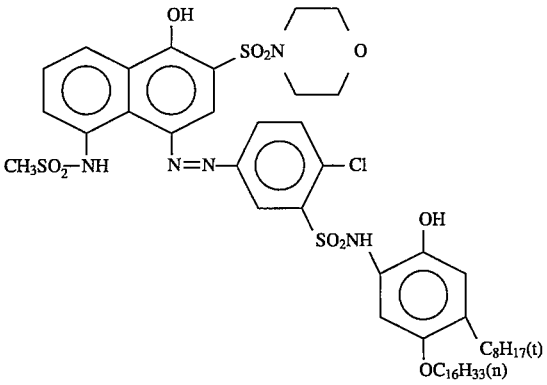

18.8 g of Yellow dye-providing compound (C) having the following structural formula, 3.8 g of Compound (1) having the following structural formula, 1.74 g of the foregoing Surface active agent (1), and 9.4 g of the foregoing High boiling organic solvent (2) were measured out. These materials were then mixed with 50 ml of ethyl acetate and dissolved at a temperature of about 60° C. to make a homogeneous solution. The solution thus obtained was then mixed with 71 g of a 14% aqueous solution of lime-treated gelatin and 73 ml of water with stirring. The mixture was then subjected to dispersion at 10,000 rpm for 10 minutes by means of a homogenizer. Thereafter, to the dispersion was added 105 ml of water for dilution. Thus, a dispersion of yellow dye-providing compound was obtained.

Yellow dye-providing compound (C)

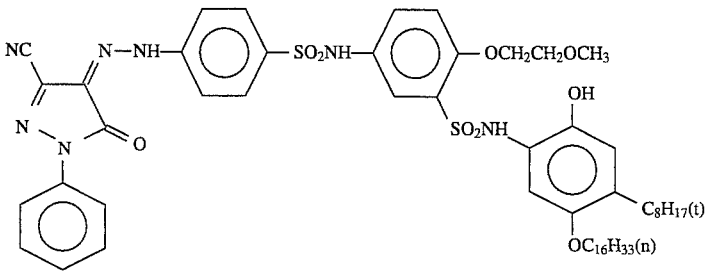

Compound (1)

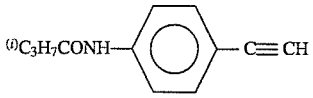

10 g of Reducing agent (A), 3 g of the foregoing Surface active agent (1), 6.3 g of the foregoing High boiling organic solvent (1), and 16 g of ethyl acetate were dissolved at a temperature of 60° C. to make a homogeneous solution. The solution thus obtained was added to a mixture of 71.4 g of a 14% acid-treated gelatin and 70.6 g of water, which had been kept at a temperature of 55° C., with stirring. The mixture was then subjected to dispersion at 10,000 rpm for 10 minutes by means of a homogenizer. Thus, a dispersion of reducing agent was obtained.

Reducing agent (A)

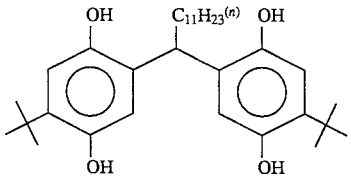

These dispersions were used to prepare a heat-developable photographic. light-sensitive material Specimen 301 as set forth in Table 15.

TABLE 15

(constitution of photographic light-sensitive material Specimen 301)

| Layer No. | Layer name | Additive | Coated amount (mg/m²) |
|---|---|---|---|
| 7th layer | Protective layer | Acid-treated gelatin | 0.39 |

TABLE 15-continued (constitution of photographic light-sensitive material Specimen 301)

| Layer No. | Layer name | Additive | Coated amount (mg/m²) |
|---|---|---|---|
| | | High boiling organic solvent (1) | 0.0354 |
| | | Reducing agent (A) | 0.053 |
| | | PMMA matting agent | 0.16 |
| | | Surface active agent (2) | 0.0066 |
| | | Surface active agent (4) | 0.069 |
| | | Surface active agent (1) | 0.026 |
| | | Surface active agent (3) | 0.0014 |
| | | Calcium nitrate | 0.005 |

Photographic light-sensitive material Specimens 302 to 305 having the same composition as Specimen 301 were prepared in the same manner as Specimen 301 except that pigments according to the present invention as set forth in Table 16 were incorporated in the 3rd or 4th layer. Further, for comparison, a photographic light-sensitive material Specimen 306 was prepared in the same manner as Specimen 301 except that Exemplary Compound (1) as described in JP-B-1-46057 was incorporated in the 4th layer in an amount of 0.20 g/m².

Exemplary Compound (1) in JP-B-1-46057

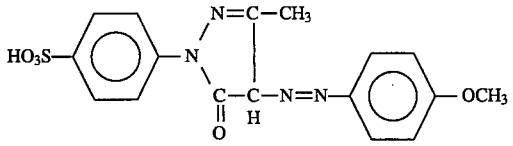

TABLE 16

| Specimen No. | 4th layer Pigment | 4th layer Coated amount ($g/m^2$) | 3rd layer Pigment | 3rd layer Coated amount ($g/m^2$) |
|---|---|---|---|---|
| 301 | — | — | — | — |
| 302 | (39) | 0.30 | — | — |
| 303 | (19) | 0.25 | — | — |
| 304 | (27) | 0.20 | — | — |
| 305 | — | — | (27) | 0.20 |
| 306 | * | 0.20 | — | — |

(Note: Specimens 301 and 306 are comparative while the others are according to the present invention)
*Exemplary Compound (1) described in JP-B-1-46057

Specimens 301 to 306 thus obtained were then subjected to the following exposure and processing.

These specimens were each exposed to light from a tungsten lamp through a blue, green and red separation filter (consisting of band pass filters with R: 600 to 700 nm; G: 500 to 590 nm; B: 400 to 490 nm) and a step wedge under 2,500 lux for 0.1 seconds.

The photographic light-sensitive materials thus exposed were each supplied with wetting water on the surface of the emulsion layer through a wire bar. The photographic light-sensitive materials were then each laminated with the image-receiving material R101 set forth in Example 1 in such an arrangement that the coated layer thereof were brought into contact with each other. The photographic light-sensitive materials were each subjected to heat development at a temperature of 83° C. for 30 seconds. The image-receiving material was then peeled off the photographic light-sensitive material to form an image on the image-receiving material.

The image on the blue exposure area and the green exposure area were measured for reflective density by means of a reflective densitometer X-Rite 310 through Filter Status A (available from The X-Rite Co., Ltd.). The results are set forth in Table 17.

TABLE 17

| Specimen | Blue exposure area B | | Blue exposure area G | | Green exposure area B | | Green exposure area G | |
|---|---|---|---|---|---|---|---|---|
| No. | Dmax | Dmin | Dmax | Dmin | Dmax | Dmin | Dmax | Dmin |
| 301 | 2.10 | 0.15 | 0.62 | 0.14 | 0.65 | 0.15 | 2.36 | 0.14 |
| 302 | 2.08 | 0.13 | 0.34 | 0.14 | 0.63 | 0.13 | 2.30 | 0.14 |
| 303 | 2.12 | 0.14 | 0.32 | 0.14 | 0.63 | 0.14 | 2.31 | 0.14 |
| 304 | 2.11 | 0.15 | 0.32 | 0.13 | 0.66 | 0.15 | 2.32 | 0.13 |
| 305 | 2.07 | 0.14 | 0.34 | 0.15 | 0.64 | 0.14 | 2.35 | 0.15 |
| 306 | 2.75 | 1.10 | 0.35 | 0.15 | 1.44 | 1.10 | 2.38 | 0.15 |

The results shown in Table 17 demonstrate that Specimen 306, comprising Exemplary Compound (1) set forth in JP-B-1-46057 in the interlayer, provides a highly stained image having a high Dmin of yellow component in the yellow image and magenta image probably because the exemplary compound itself is transferred. On the other hand, Specimens 302 to 305, comprising pigments according to the present invention, provide an image free of stain having a low yellow Dmin and Dmax of yellow component in the magenta image regardless of whether the pigment is incorporated in the interlayer or emulsion layer and exert a good filter effect as compared with Specimen 301.

While the invention has been described in detail and with reference to specific embodiments thereof, it will be apparent to one skilled in the art that various changes and modifications can be made therein without departing from the spirit and scope thereof.

What is claimed is:

1. A diffusion transfer heat-developable color photographic light-sensitive material comprising i) a support having thereon at least one light-sensitive silver halide emulsion layer and a nondiffusing dye-providing compound which releases or forms a diffusion dye in response to or in counter response to a reaction by which silver halide is reduced to silver in the presence of a reducing agent, and ii) a substantially water-insoluble condensed polycyclic organic solid pigment selected from the group consisting of an isoindolinone, an anthraquinone, a flavanthrone, an anthraquinone, a quinophthalone and a copper complex salt of an azomethyne and having a maximum absorption spectrum of 500 nm or less in at least one of said at least one light-sensitive silver halide emulsion layer and a layer(s) adjacent thereto.

2. The diffusion transfer heat-developable color photographic light-sensitive material as in claim 1, which comprises at least three light-sensitive silver halide emulsion layers, said layers being spectrally sensitized to blue, green and red, respectively, wherein said organic solid pigment is present in at least one of the layer between the blue-sensitive layer and the green-sensitive layer and the layer between the blue-sensitive layer and the red-sensitive layer.

3. The diffusion transfer heat-developable color photographic light-sensitive material as in claim 1, wherein the layer adjacent to the silver halide emulsion layer is selected from the group consisting of a dye donor-containing layer, an interlayer, and a light sensitive silver halide emulsion layer having a color sensitivity different from that of said silver halide emulsion layer.

4. The diffusion transfer heat-developable color photographic light-sensitive material as in claim 1, wherein the amount of the organic solid pigment in the light-sensitive material is in the range of 1 mg to 5,000 mg per $m^2$ of the light sensitive material and in the range of 1 to 200% by weight based on the weight of the binder used in the layer containing the organic solid pigment.

5. The diffusion transfer heat-developable color photographic light-sensitive material as in claim 1, wherein the reducing agent is present in the light-sensitive material.

6. A diffusion transfer heat-developable color photographic light-sensitive material comprising i) a support having thereon at least one light-sensitive silver halide emulsion layer and a nondiffusing dye-providing compound which releases or forms a diffusive dye in response to or in counter response to a reaction by which silver halide is reduced to silver in the presence of a reducing agent, and ii) a substantially water-insoluble organic solid pigment having a maximum absorption spectrum of 500 nm or less in at least one of said at least one light-sensitive silver halide emulsion layer and a layer(s) adjacent thereto, wherein said organic solid pigment is represented by the following general

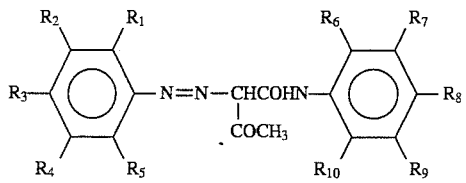

(I)

wherein $R_1$ to $R_{10}$ each represents a hydrogen atom, or a substituent selected from the group consisting of a halogen atom, an alkyl group, an alkoxy group, a nitro group, an acyl group, an aryl group, an aryloxy group, a sulfamoyl group, an alkylsulfamoyl group, an arylsulfamoyl group, an alkoxycarbonyl group, an aryloxycarbonyl group, a carbamoyl group, an alkylcarbamoyl group, an arylcarbamoyl group, an acylamino group, an alkylsulfonylamino group, an arylsulfonylamino group, a ureido group and group represented by the general formula (I-a):

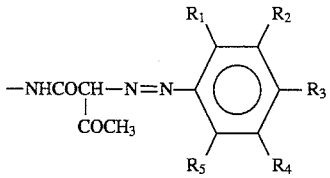

(I-a)

wherein $R_1$ to $R_5$ are as defined in the general formula (I); said substituents may be further substituted with at least one of these substituents; with the proviso that $R_1$ and $R_2$, $R_2$ and $R_3$, $R_3$ and $R_4$, $R_4$ and $R_5$, $R_6$ and $R_7$, $R_7$ and $R_8$, $R_8$ and $R_9$ or $R_9$ and $R_{10}$ on the same benzene ring may together form a heterocyclic ring; said organic solid pigment may be in a form of a bis compound formed by connecting two molecules represented by the general formula (I) via the respective $R_3$ or $R_8$, or via a single bond at the position of $R_3$ or $R_8$ on the benzene ring.

7. The diffusion transfer heat-developable color photographic light-sensitive material as in claim 1, wherein said organic solid pigment is incorporated into the light-sensitive material in the form of a fine solid dispersion in a hydrophilic binder.

8. The diffusion transfer heat-developable color photographic light-sensitive material as in claim 7, wherein the average grain diameter of the organic solid pigment in the dispersion is in the range of 0.001 to 5 μm.

9. A process for forming a color image which comprises subjecting a diffusion transfer heat-developable color photographic light-sensitive material comprising i) a support having thereon at least on light-sensitive silver halide emulsion layer and a nondiffusing dye-providing compound which releases or forms a diffusive dye in response to or in counter response to a reaction by which silver halide is reduced to silver in the presence of a reducing agent, and ii) a substantially water-insoluble condensed polycyclic organic solid pigment selected from the group consisting of an isoindolinone, an anthraquinone, a flavanthrone, an anthraquinone, a quinophthalone and a copper complex salt of an azomethyne and having a maximum absorption spectrum of 500 nm or less in at least one of said at least one light-sensitive silver halide emulsion layer and a layer(s) adjacent thereto, to imagewise exposure to light, heat-developing said color photographic light-sensitive material in the presence of a reducing agent, and transferring a diffusible dye thus released or formed to an image receiving material.

10. The process for forming a color image as in claim 9, wherein the process comprises developing the material in the presence of water and a base precursor.

11. The process for forming a color image as in claim 10, wherein said base precursor is a combination of a scarcely water-soluble basic metal compound and a complexing agent capable of undergoing a complexing reaction with metal ions constituting said basic metal compound in the presence of water as a medium.

* * * * *